United States Patent [19]

Arai

[11] 4,449,835

[45] May 22, 1984

[54] PRINTING DEVICE

[75] Inventor: Kenichiro Arai, Shiojiri, Japan

[73] Assignees: Epson Corporation, Nagano; Kabushiki Kaisha Suwa Seikosha, Tokyo, both of Japan

[21] Appl. No.: 375,777

[22] Filed: May 6, 1982

[30] Foreign Application Priority Data

May 7, 1981 [JP] Japan ..... 56-68822
Feb. 22, 1982 [JP] Japan ..... 57-26978

[51] Int. Cl.[3] ..... B41J 1/34

[52] U.S. Cl. ..... 400/161; 400/145; 400/185

[58] Field of Search ..... 400/145, 145.1, 145.2, 400/149, 146, 185, 187, 161.2

[56] References Cited

U.S. PATENT DOCUMENTS

| | | | |
|---|---|---|---|
| 3,548,993 | 12/1970 | Behrens | 400/161.2 |
| 3,611,412 | 10/1971 | Gibby | 400/145 X |
| 3,913,722 | 10/1975 | Bondle et al. | 400/145.2 |
| 4,023,665 | 5/1977 | Boyden | 400/145.1 X |
| 4,030,588 | 6/1977 | Hanagata et al. | 400/185 X |
| 4,043,439 | 8/1977 | Daly | 400/161.3 |

*Primary Examiner*—Edward M. Coven

*Attorney, Agent, or Firm*—Blum, Kaplan, Friedman, Silberman & Beran

[57] ABSTRACT

A printing device comprises a motor, a conversion mechanism for converting rotation of the motor into first and second outputs, a selection mechanism for alternately supplying the first and second outputs, a type member for being supplied with the first output from the conversion mechanism, and a printing mechanism for being supplied with the second output. The printing mechanism is engageable with the type member to effect printing on a sheet of printing paper. The selection mechanism comprises a locking member for alternately catching and locking the first and second outputs, an action member for acting on the locking member to catch and lock the second output when the locking member is in a standby condition and to catch and lock the first output when the locking member is in an operating condition, an electromagnetic trigger member for shifting the locking member from the standby condition to the operating condition, and a return drive member supplied with the second output for acting on the locking member in order to return the locking member from the operating condition to the standby condition.

14 Claims, 20 Drawing Figures

FIG. 5
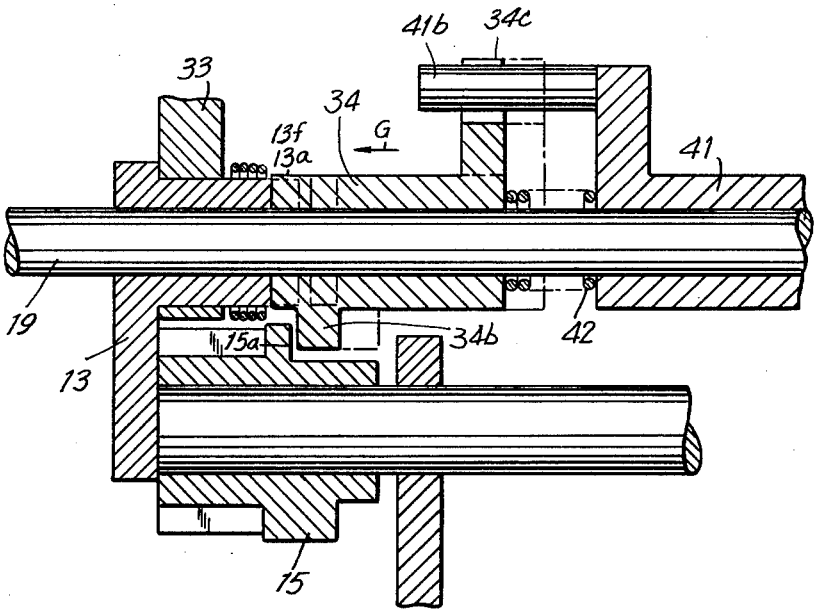
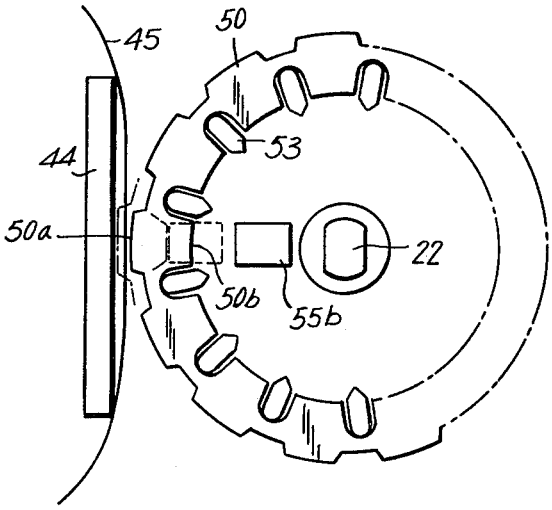
FIG. 6

PRINTING DEVICE

BACKGROUND OF THE INVENTION

The present invention relates generally to serial printing devices in which a type member is moved along a line in the printing direction, and more particularly, to a small printing device in which a conversion mechanism providing first and second outputs alternatively is provided. The first and second outputs are alternately switched to select type elements and for printing. Such a small printing device is applicable to a portable or pocket-size electronic computer.

Examples of a conventional printing devices in which selection of type elements used for printing is controlled using a differential mechanism as a conversion mechanism capable of providing first and second outputs are disclosed in U.S. Pat. Nos. 3,548,993 and 4,043,439. Disadvantageously in each of the conventional printing devices, the carriage is intricate in configuration and bulky because the type member, the printing mechanism and the selection mechanism are mounted on the carriage.

In general, a conventional printing device combined with a portable electronic computer prints symbols at the two lowest print positions and numerals at the remaining lateral positions of a line. In the printing device disclosed in U.S. Pat. No. 4,043,439, symbol types and numeral types are arranged on the outer wall of a single type wheel. Accordingly, the diameter of the type wheel is necessarily large and hence, it is impossible to miniaturize the printing device. In the case where symbols are printed at two lowest positions and numerals are printed at the remaining positions, the desired type element must be selected from among all of the elements available, which takes a relatively long time and makes the printing speed slow. Furthermore, the conventional device suffers a drawback in that, if it is intended to increase the number of type elements available for printing, the type head necessarily becomes larger.

Presently, there is strong demand to reduce the size of pocket-size electronic computers with a printer. However, it is considerably difficult to miniaturize a pocke-size electronic computer using the above-described conventional printing device in which the carriage is large and intricate.

In the conventional printing device disclosed in U.S. Pat. No. 3,548,993, electromagnets are provided for the first and second outputs of the differential mechanism. Therefore, the printing device is large in size and high in manufacturing cost. Furthermore, since current is continuously applied to the electromagnets during the printing operation, power consumption is relatively large.

This drawback has been eliminatted by the printing device disclosed in U.S. Pat. No. 4,043,439 to some extent. In that printing device, only one electromagnet is used, and the application of current to the electromagnet is suspended relatively early in the printing operation. However, in addition to a switching mechanism for switching type selecting operation and a printing operation, a positioning element for holding a selected type element during the printing operation must be employed by the printing device. Therefore, necessarily the number of components forming the printing device is large and the printing device is intricate in construction and large is size. Neither of the aforementioned patents provides a detailed description of place shifting, sheet feeding and carriage returning operations. Each of these operations needs a corresponding mechanisms and power source. Accordingly, the conventional printing devices are not suitable for pocket-size electronic computers due to their intricate construction, bulky size and high manufacturing cost.

An example of a conventional serial printing device for a small portable electronic computer has been disclosed in U.S. Pat. No. 4,051,942. This conventional serial printing device also has an intricate construction and large electromagnetic plungers are used for printing, place shifting, sheet feeding and carriage returning operations. Furthermore, the device uses a pulse motor to select type elements. Accordingly, the device is large in size and high in manufacturing cost. In addition, the device uses wire to shift the printing location. Since the wire is liable to stretch or move sidewardly, the printing position may not be accurate.

Another conventional printing device has been disclosed by U.S. Pat. No. 3,876,053 in which a rack and a shifting cam are used as a shifting mechanism. In that printing device, the type selecting mechanism is considerably intricate, and the printing mechanism is so designed that the type head is locked by a tab mounted between the frames. Therefore, that printing device is also intricate in construction and large in size.

What is needed is a printing device which is of simple construction, has few parts, small size and consumes little electrical energy.

SUMMARY OF THE INVENTION

The invention is intended to eliminate all of the above-described difficulties accompanying a conventional small printing device.

Generally speaking, in accordance with the invention, there is provided a printing device of high efficiency, small size and simple construction. The printing device includes a carriage, a type member engaged with the carriage, a shifting mechanism for moving the carriage in a printing direction, a printing mechanism for printing a printing sheet upon engagement with the type member, a selection mechanism, a conversion mechanism coupled to an electric motor for converting rotation of the motor into first and second outputs with the first and second outputs being supplied alternately by a selection mechanism, a sheet feeding mechanism for feeding the printing sheet, and a returning mechanism for returning the carriage to standby position. Specifically, in a preferred embodiment, the selection mechanism includes a locking member for alternately catching and locking the first and second outputs, an elecromagnetic trigger member for operating the locking member, a control member coupled to the second output, and a switching member, sheet feeding mechanism and the returning mechanism. The switching member is controlled by the electromagnetic trigger member. The moving carriage supports the type wheels and printing mechanism but is generally free of other mechanisms associated with selection and printing.

Accordingly, it is an object of this invention to provide an improved printing device in which the number of mechanisms mounted on the carriage is reduced, thereby to reduce the size and weight of the carriage and to reduce the size of the printing device itself.

Another object of this invention is to provide an improved printing device in which the number of type elements can be increased without increasing the diameter of the type member thereof.

A further object of the invention is to provide an improved small serial printing device which is simple in construction, and in which the number of symbol type elements is increased without increasing the diameter of the type belt while still increasing the printing speed.

Still another object of the invention is to provide an improved printing device in which an electromagnetic brake is employed as an electromagnetic unit to reduce the power consumption and thereby to increase the service life of a battery used therein.

Yet another object of the invention is to provide an improved printing device in which a load applied to an electromagnetic unit during a type selecting operation is reduced to further decrease the power consumption.

Another object of the invention is to provide an improved printing device small in size and weight in which the selection mechanism is simplified to reduce the number of components.

A further object of the invention is to provide an improved printing device having simple operations in which a type-element selecting operation, the printing operation and a print place shifting operation are carried out merely by a switching operation of a differential mechanism thereof.

Still another object of the invention is to control all of the operations of a printing device with one electric motor and one electromagnetic member.

Yet another object of the invention is to simplify a control circuit adapted to control a printing device.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 5 is a sectional view of the carriage return mechanism;

FIG. 6 is a sectional side view of a type member;

DESCRIPTION OF THE PREFERRED EMBODIMENTS

Preferred embodiments of the invention will be described with reference to the accompanying drawings.

Figure 1:
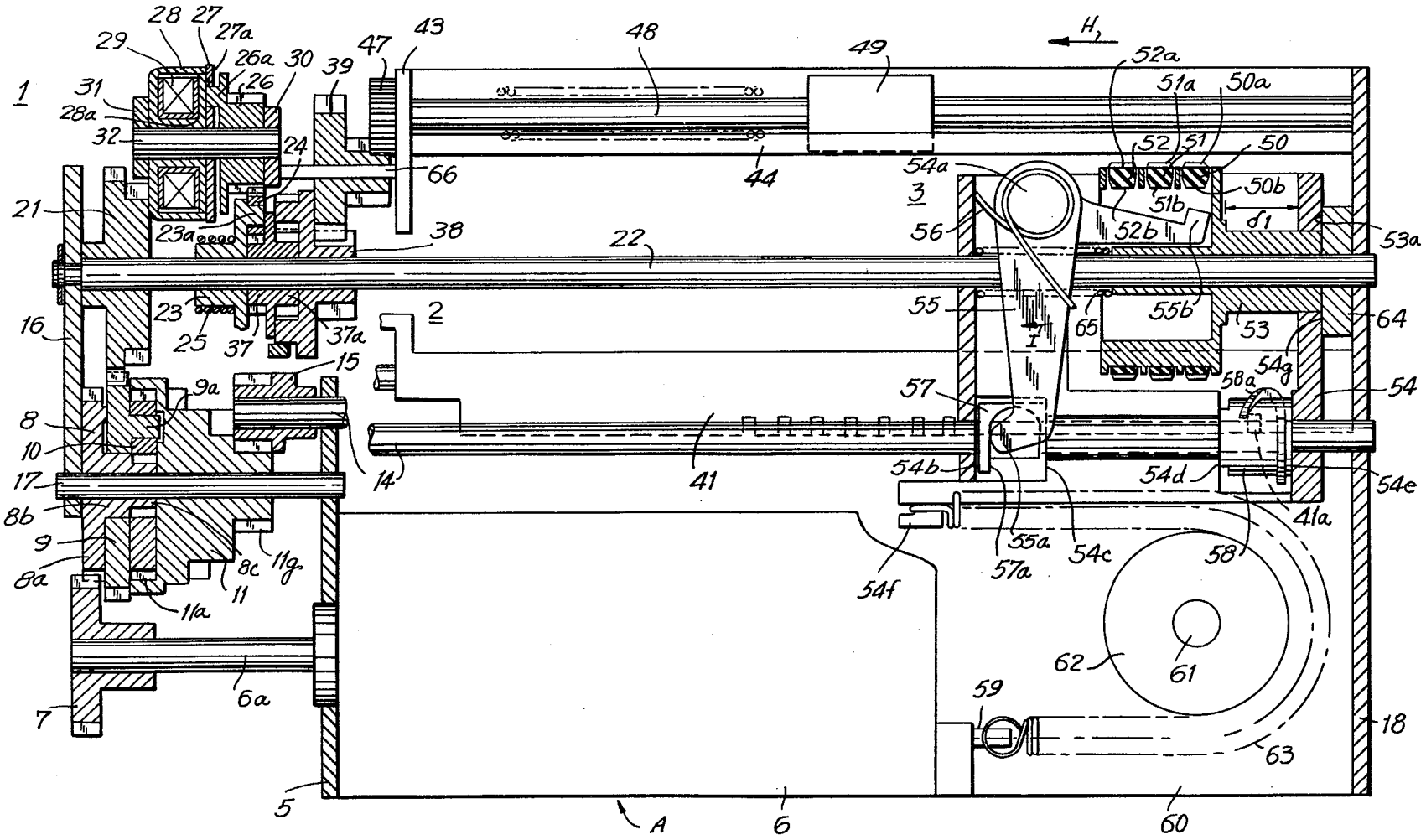
FIG. 1 is a sectional plan view of a printing device constructed in accordance with the invention.
Figure 2:
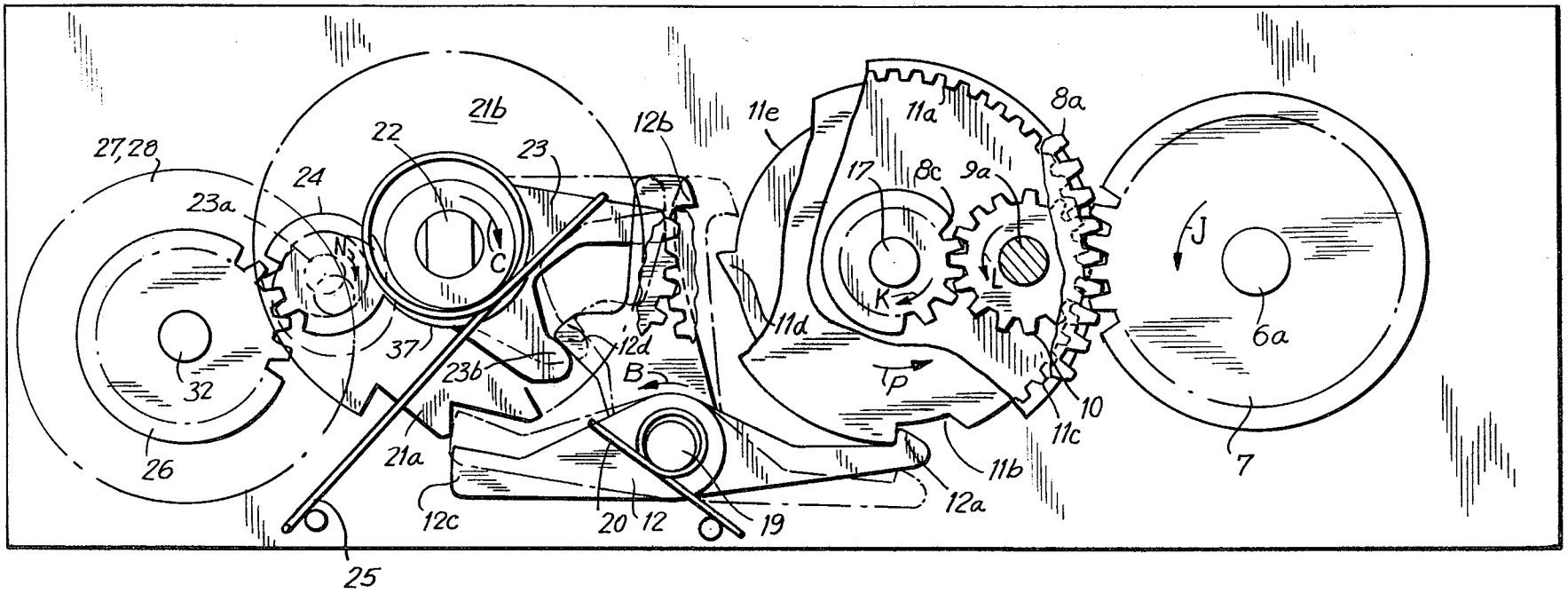
FIG. 2 is a side view of a selection mechanism.
Figure 3:
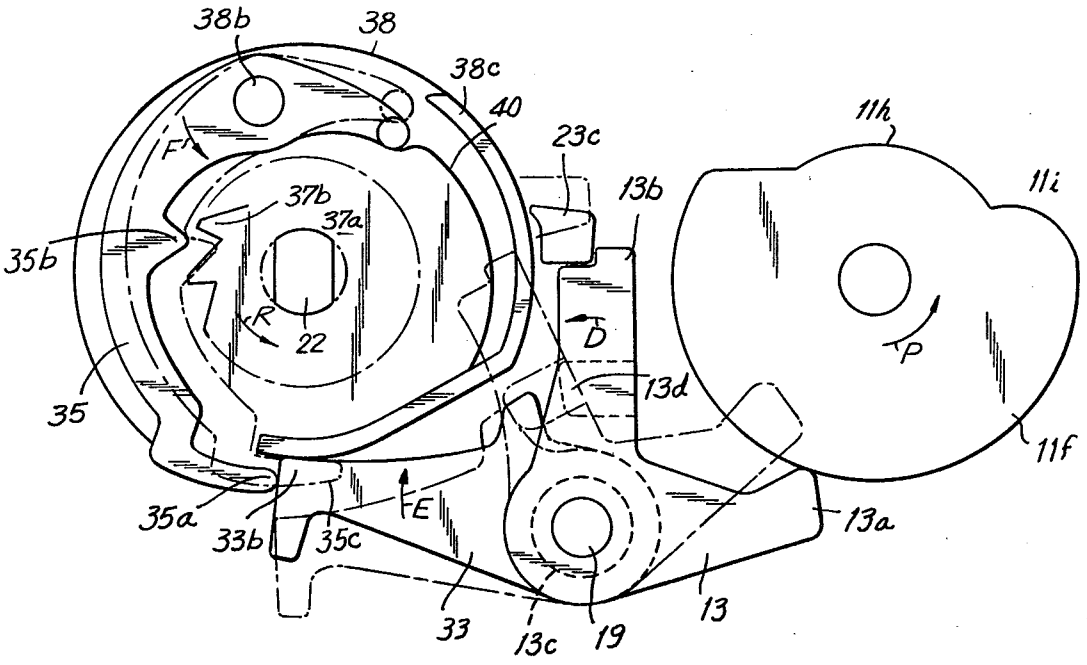
FIG. 3 is a side view of a sheet feeding and carriage returning mechanism.
Figure 4:
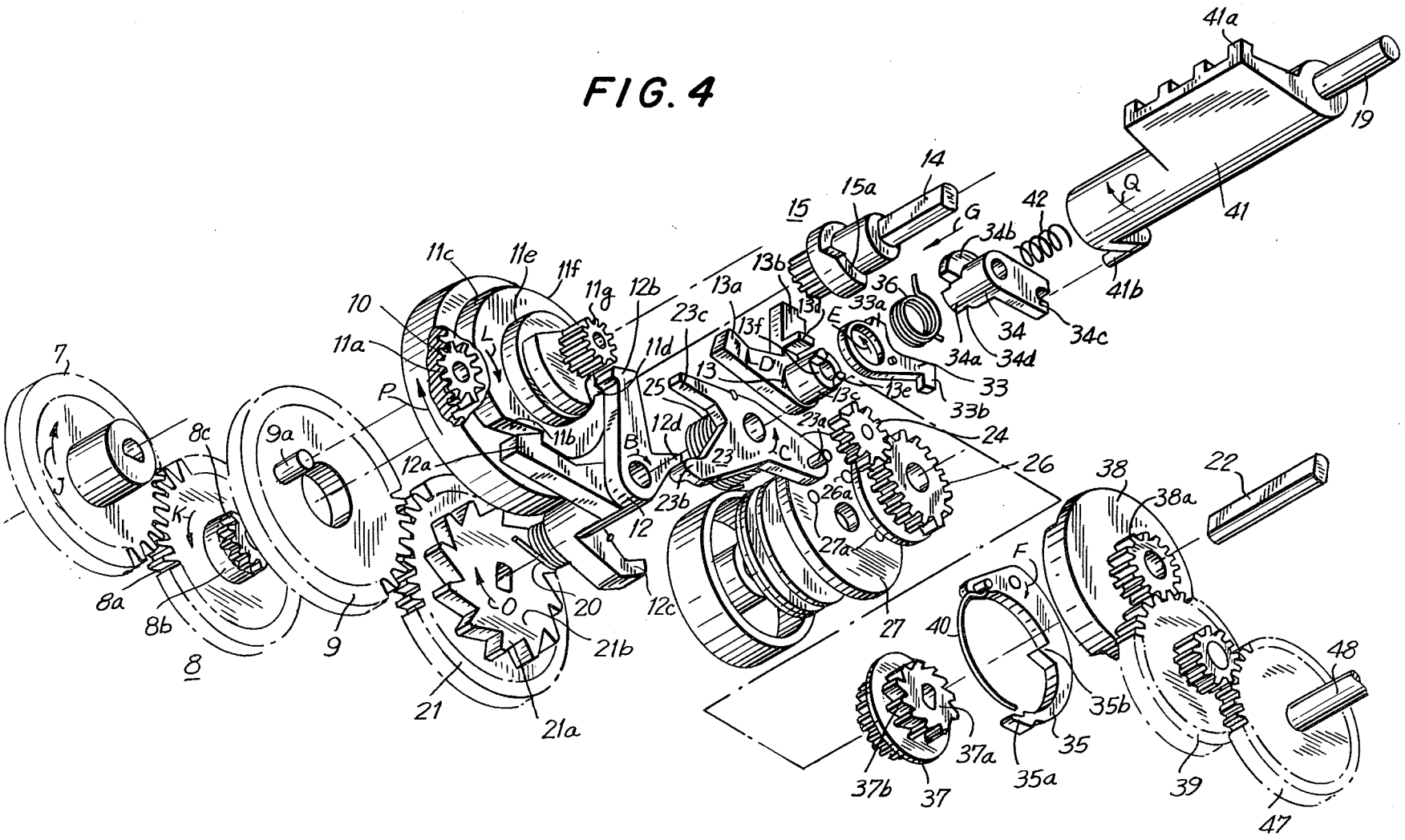
FIG. 4 is a perspective view of the selection mechanism and the sheet feeding and carriage returning mechanism as viewed in the direction of the arrow A in FIG. 1.

FIG. 1 is a sectional plan view showing a selection mechanism 1, a sheet feeding and carriage returning mechanism 2, and a carriage 3. FIG. 2 is a side view of the selection mechanism 1. FIG. 3 is a side view of the sheet feeding and carriage returning mechanism 2. FIG. 4 is a perspective view showing the selection mechanism 1 and the sheet feeding and carriage returning mechanism 2 as viewed in the direction of an arrow A in FIG. 1.

These mechanisms will each be described.

(1) Selection Mechanism

An electric motor 6 is fixedly secured to a frame 5. A motor gear 7 is fixedly secured to the motor shaft 6*a*. A reduction gear 8 is made up of a gear 8*a* engaged with the motor gear 7, a bearing 8*b* which rotatably supports a selection drive gear 9, and a sun gear 8*c* engaged with a planet gear 10. The selection drive gear 9 has a bearing 9*a* which supports the planet gear 10. A printing switching cam 11 is made up of an inner gear 11*a* engaged with the planet gear 10, a cam 11*c* having a cut 11*b* in its periphery and which is engaged with a pawl 12*a* of a selection pawl 12 (FIGS. 2 and 4) serving as a locking member, and a cam 11*e* having a protrusion 11*d* extending from its periphery and which is engaged with a pawl 12*b* of the selection pawl 12. The printing switching cam also includes a cam 11*f* serving as a control member which is engaged with a portion 13*a* of a positioning lever 13 (FIGS. 3 and 4) serving as a switching member, and a gear 11*g* which is engaged with a printing gear 15 which is fixedly secured to a printing shaft 14 with a gear ratio of 1:1.

The reduction gear 8 and the printing switching cam 11 are supported on a shaft 17 which is pivotally supported between the frames 5 and 16. A conversion mechanism utilizing a planet gear, i.e., a differential mechanism, is constituted by the sun gear 8*c*, the planet gear 10, the inner gear 11*a* and the selection drive gear 9. The selection pawl 12 is rotatably mounted on a shaft 19 which extends between the frame 16 and a frame 18 and is urged in the direction of the arrow B by a spring 20. The selection gear 21, which is engaged with the selection drive gear 9, has a selection ratchet 21*b* which has teeth 21*a* arranged regularly on its periphery. The ratchet 21*b* is engaged with the pawl 12*c* of the selection pawl 12. The selection gear 21 is fixedly mounted on a type shaft 22 which is rotatably supported between the frames 16 and 18. The trigger lever 23 is made up of a shaft 23*a* which rotatably supports a trigger planet gear 24, a portion 23*b* engaged with the portion 12*d* of the selection pawl 12, and a portion 23*c* engaged with a portion 13*b* of the positioning lever 13. The trigger lever 23 is pivotally mounted on the type shaft 22 and is urged in the direction of the arrow C by a spring 25.

A trigger sun gear 37, which is integral with a sheet feeding clutch ratchet 37*a*, is fixedly mounted on the type shaft 22. A brake gear 26, engaged with the trigger planet gear 24, has a pin 26*a* which is engaged with a hole 27*a* which is cut in a brake disc 27 made of magnetic material. An electromagnetic brake yoke 28 made of magnetic material has an opening 28*a* which confronts the brake disc 27. A coil 29 is arranged in the brake yoke 28. The break gear 26, the brake disc 27 and the brake yoke 28 are mounted on a shaft 32 which extends between frames 30 and 31. The brake yoke 28 is mounted fixedly on the frame 31 so that it cannot rotate. Thus, an electromagnetic member, i.e., an electromagnetic brake is constituted by the electromagnetic brake yoke 28, the brake disc 27 and the coil 29.

The construction of the selection mechanism 1 is as described above.

(2) Sheet Feeding and Carriage Returning Mechanism

The positioning lever 13 has a portion 13*a* engaged with the cam 11*f* of the printing switching cam 11, a portion 13*b* engaged with the portion 23*c* of the trigger lever 23, a portion 13*c* which rotatably supports a sheet feeding trigger lever 33, a portion 13*d* engaged with a portion 33*a* of the sheet feeding trigger lever 33, and a protrusion 13*e* which is engaged with a protrusion 34*a* of a positioning transmission lever 34 which functions as a connecting member. The positioning lever 13 is rotatably mounted on a shaft 19 and is urged in the direction of the arrow D by a spring (not shown). The sheet feeding trigger lever 33, which has a portion 33*b* which is engaged with a portion 35*a* of a sheet feeding clutch pawl 35, is urged in the direction of the arrow E by a spring 36. The sheet feeding clutch pawl 35 is rotatably mounted on the shaft 38*b* of a sheet feeding drive gear 38. The drive gear 38 has a gear 38*a* enaged with a sheet feeding transmission gear 39 and is pivotally mounted on the type shaft 22. The sheet feeding clutch pawl 35 is urged in the direction of the arrow F by a spring 40, one end of which is fixedly secured to the sheet feeding drive gear 38. The sheet feeding clutch pawl 35 has a pawl 35*b* which is engaged with teeth 37*b* of a sheet feeding clutch ratchet 37*a*, which teeth are regularly arranged on its periphery. A sheet feeding gear 47 is fixedly secured to a shaft 48 on which a sheet feeding roller 49 is fixedly mounted. The gear 47 is engaged with the sheet feeding transmission gear 39 which is pivotally mounted on a shaft 66 extending between frames 30 and 43. The positioning transmission lever 34 has a portion 34*b* which is engaged with an end face cam 15*a* of a printing gear 15 and a portion 34*c* which is engaged with a portion 41*b* of a positioning plate 41. The positioning plate 41, pivotally mounted on a shaft 19, has a plurality of teeth 41*a*. The positioning transmission lever 34 is urged in the direction of the arrow G by a spring 42 (FIG. 5).

The arrangement of the sheet feeding and carriage returning mechanism is as described above.

(3) Carriage

A type belt 50 having type elements 50*a* on its outer side and protrusions 50*b* on its inner side, a type belt 51 having type elements 51*a* and protrusions 51*b* and a type belt 52 having type elements 52*a* and protrusions 52*b*, are mounted on a type holder 53 which is mounted slidably and non-rotatably on the type shaft 22. The type holder 53 is in the form of a cylinder, in the outer wall of which holes are formed the protrusions 50*b*, 51*b* and 52*b* of the type belts 50, 51 and 52 respectively loosely fitted thereinto. The type belts 50, 51 and 52 are made of an elastic material such as rubber. The type holder 53 is held on a carriage frame 54 in such a manner as to be movable over a predetermined distance, and is urged in the direction of the arrow H by a spring 65. The carriage frame 54, being guided by the printing shaft 14 and the type shaft 22, is movable in the direction of the arrow H. A hammer 55, rotatably mounted on a shaft 54*a* provided on the carriage frame 54, is urged in the direction of the arrow 1 by a spring 56. The hammer 55 has one end portion 55*a* which is engaged with an end face 57*a* of a printing cam 57. The printing cam 57 is held between portions 54*b* and 54*c* of the carriage frame 54 and is mounted on the printing shaft 14 in such a manner that it is slidable but not rotatable. The hammer 55 has another end portion 55*b* which is arranged so as to engage selectively with the protrusions 50*b*, 51*b* and 52*b* of the type belts 50, 51 and 52. A shifting cam 58 has a line cam 58*a* which is engaged with the teeth 41*a* of the positioning plate 41. The shifting cam 58 is held between portions 54*d* and 54*e* of the carriage frame 54 and is mounted on the printing shaft 14 in such a manner that it is slidable but not rotatable.

The carriage is arranged as described above.

Operation of the printing device thus constructed will be described.

(1) Initial Setting

Figure 10:
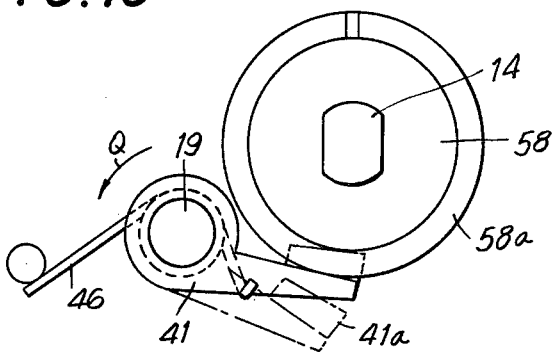
FIG. 10 is a sectional side view of a shifting mechanism.

Initial setting is carried out before selection and printing. The shifting cam 58 is disengaged from the tooth 41*a* of the positioning plate 41 according to a method described below (see the two-dot chain line in FIG. 10), and the carriage 3 is moved by means of a return spring 63 in the direction opposite to the direction of the arrow H until a portion 54*g* of the carriage frame 54 abuts against a carriage stop 64 which is fixedly secured to the frame 18. The return spring 63 is directed by a guide roller 62 which is rotatably mounted on a shaft 61, the ends of which are fixedly secured to a portion 54*f* of the carriage frame 54 and a frame bottom plate 60, respectively. The return spring 63 urges the carriage 3 in the direction opposite to the direction of the arrow H with one end thereof connected to a spring hook 59 on the frame bottom plate 60.

When the portion 54*g* of the carriage frame 54 abuts against the carriage stop 64, simultaneously, a portion 53*a* of the type holder 53 abuts against the carriage stop 64. Accordingly, the portion 53*a* moves inside the carraige frame 54 while compressing the type spring 65 and stops where the portion 55*b* of the hammer 55 confronts the type belt 50. The type spring 65 is weaker than the return spring 63. By means of a spring 20, the pawl 12*a* of the selection pawl 12 is engaged with the cut 11*b* of the cam 11*c* while the pawl 12*c* is disengaged from the tooth 21*a* of the selection ratchet 21, as shown by the solid line in FIG. 2. The trigger lever 23 is in a standby position in which its portion 23*c* is held in abutment against a portion 13*b* of the positioning lever 13 by means of a spring 25 as shown by the solid line in FIGS. 2 and 3.

(3) First Place Selection

As the motor 6 rotates, the motor gear 7 is turned in the direction of the arrow J, and accordingly, the reduction gear 8 and the planet gear 10 are turned in the directions of the arrows K and L, respectively. In this operation, the printing switching cam 11 is maintained locked by the pawl 12*a* and therefore the inner gear 11*a* cannot be turned. As the inner gear 11*a* cannot be turned, the planet gear 10 revolves around the sun gear while rotating around its axis to thus cause the selection drive gear 9 to turn in the direction of the arrow K via a planet shaft 9*a*. The rotation of the selection drive gear 9 causes the selection gear 21 to turn in the direction of the arrow O and causes the type shaft 22, the trigger drive gear 37, the trigger planet gear 24, the brake gear 26, the brake disc 27 and the type holder 53 to turn.

A desired type element is selected by controlling the application of current to the coil 29 with a type position signal which is provided by a detecting device (not shown) which is adapted to produce a type position signal in correspondence to the position of a type element 50*a* in a conventional manner. The current is applied to the coil 29 slightly before a letter or numeral of a selected type element confronts a platen 44 which is mounted between the frames 18 43. Upon application of current to the coil 29, the brake disc 27 is attracted by the electromagnetic brake yoke 28. Since the brake yoke 28 is not rotatable, the rotation of the brake disc 27 is stopped, whereupon rotation of the brake gear 26 locked with the pin 26*a* is also stopped. Even after the brake gear 26 has been stopped, rotation of the trigger planet gear 24 continues. That is, the gear 24 revolves around the trigger drive gear 37 in the direction opposite to the direction of the arrow C while rotating around its axis in the direction of the arrow N to thus cause the trigger lever 23 to turn via the shaft 23*a* in the direction opposite to the direction of the arrow C against the elastic force of the spring 25. As the trigger lever 23 turns, its portion 23*b* turns the selection pawl 12 in the direction opposite to the direction of the arrow B so that the pawl 12*c* engages with a tooth 21*a* of the selection ratchet 21*b* to stop the rotation of the ratchet 21*b* as indicated by the chain line in FIG. 2. When the selection ratchet 21*b* is locked, rotation of the type shaft 22 and the type holder 53 is stopped as a result of which the desired type element 50*a* is confronted with the platen 44. In this manner, type element selection is achieved (FIG. 6).

(3) First Place Printing and Place Shifting

Simultaneously when the selection pawl 12 is turned in the direction opposite to the direction of the arrow B by rotation of the trigger lever 23 to select a desired type element, the pawl 12*a* is disengaged from the cut 11*b* to allow free rotation of the printing switching cam 11. In this operation, rotation of the selection ratchet 21*b* is maintained stopped by the pawl 12*c*, and therefore rotation of the selection gear 21 and the selection drive gear 9 is also stopped. Therefore, rotation of the planet gear 10 causes the inner gear 11*a* and accordingly, the printing switching cam 11 to turn in the direction of the arrow P. Rotation of the printing switching cam 11 causes the printing gear 15, the printing shaft 14, the printing cam 57 and the shifting cam 58 to turn. As the printing cam 57 is turned, the hammer 55 is turned in the direction opposite to the direction of the arrow I by the cam lead of the cam end face 57*a* so that the portion 55*b* of the hammer 55 is engaged with the protrusion 50*b* of the type belt 50 thereby pushing the type belt 50 outwardly. As a result, the type element 50*a* is pressed through the printing sheet 45 against the platen 44 thus achieving printing (as indicated by the two-dot chain line in FIG. 6). An ink roll or the like (not shown) is used to coat the surface of the type element 50*a* with ink in the conventional manner.

Figure 7:
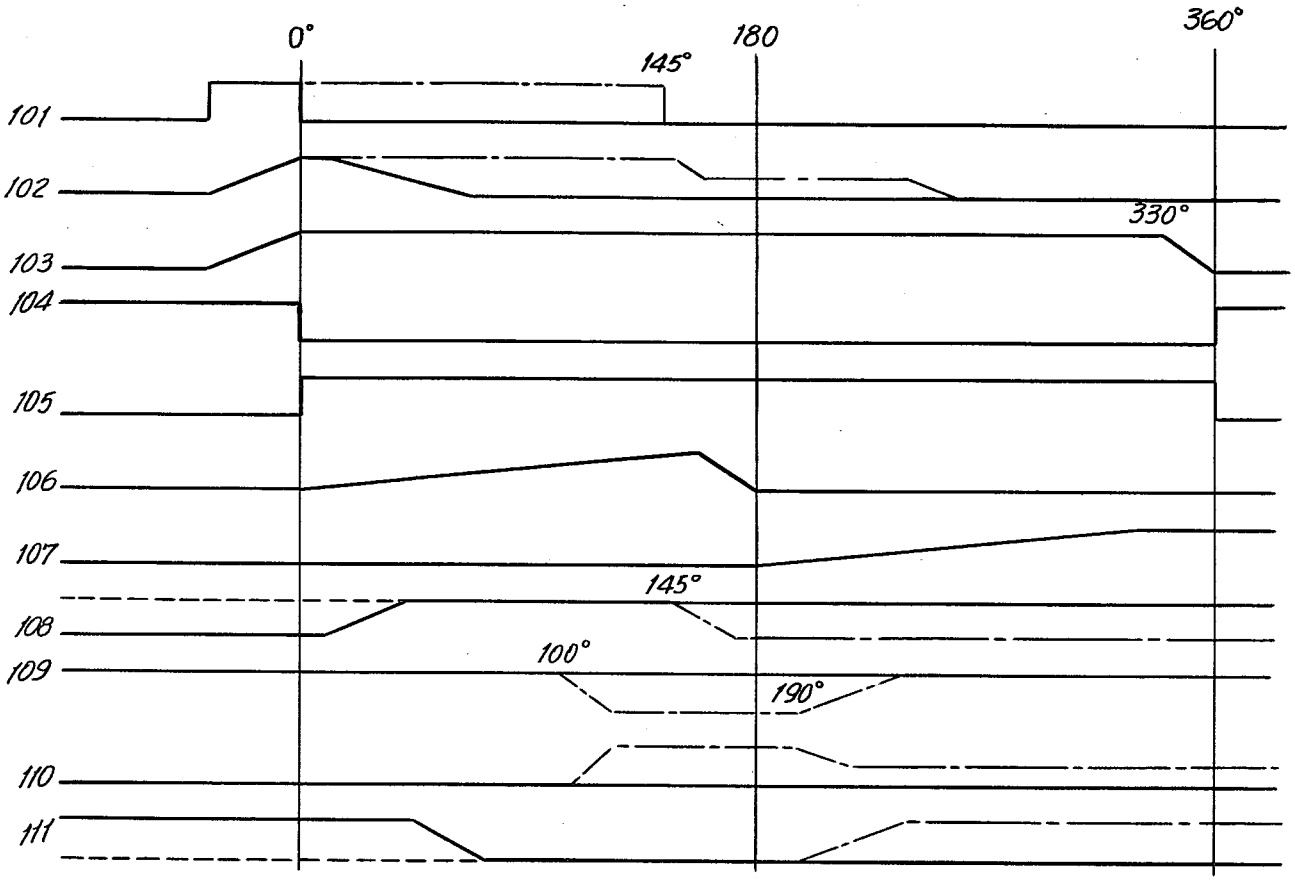
FIG. 7 is a timing chart of operation of the printing device in accordance with the invention.

FIG. 7 is a timing chart showing the operations of the relevant elements with respect to one revolution of the printing switching cam 11 and accordingly, the printing shaft 14. In FIG. 7, waveform 101 indicates application of current to the soil 29; waveform 102 indicates operation of the trigger lever 23; waveform 103 indicates operation of the selection pawl 12; waveform 104 indicates rotation of the type shaft 22. Waveform 105 indicates rotation of the printing switching cam 11 and accordingly, the printing shaft 14. Waveform 106 illustrate cam lead of the printing cam 57; waveform 107 indicates cam lead of the shifting cam 58; waveform 108 operation in the direction of the arrow G of the positioning transmission lever 34; waveform 109, operation of the positioning lever 13; 110, operation of the sheet feeding trigger lever 33, and waveform 111, operation of the positioning plate 41.

Application of current to the coil 29 is suspended when the printing switching cam 11 starts rotating (indicated by the solid line in FIG. 7). However, then the selection pawl 12 is in operation with the pawl 12*a* engaged with the periphery of the cam 11*c*. As the disc brake 27 is freely rotatable, by suspending the application of current to the coil 29, the trigger lever 23 is turned in the direction of the arrow C, returning to its standby position (the solid line in FIG. 2) while turning the trigger planet gear 24, the brake gear 26 and the brake disc 27 with the aid of the spring 20. Immediately upon the start of rotation of the printing gear 15, the positioning transmission lever 34 is moved in the direction opposite to the direction of the arrow G by the end face cam 15*a* of the printing gear 15 to be disengaged from the protrusion 13*e* of the positioning lever 13, thus becoming freely rotatable while the positioning plate 41 engaging the portion 34*c*, being urged in the direction of the arrow Q by the spring 46, is turned in the direction of the arrow Q to cause the tooth 41*a* to engage with the cam 58*a* of the shifting cam 58 (the solid line in FIG. 10). When the cam 11*f* of the printing switching cam 11 has turned through about 100°, the cut 11*b* confronts the portion 13*a* of the positioning lever 13. However, since the trigger lever 23 has returned to its standby position, the portion 13*b* is locked by portion 23*c* so that the positioning lever 13 is not operated. Therefore, the protrusion 34*a* of the positioning transmission lever 34 is abutted against the protrusion 13*c* of the positioning lever 13. Even after the cam 15*a* of the printing gear 15 is moved away, the positioning transmission lever 34 is not moved in the direction of the arrow G. Thus, the tooth 41*a* of the positioning plate 41 is maintained engaged with the cam 58*a* of the shifting cam 58.

The printing operation is ended when the printing shaft 14 has turned through 180°. When the printing shaft 14 is further turned, the cam 58*a* of the shifting cam 58 is engaged with the tooth 41*a* of the positioning plate 41 and the shifting cam 58 is moved in the direction of the arrow H by the cam lead.

Figure 8:
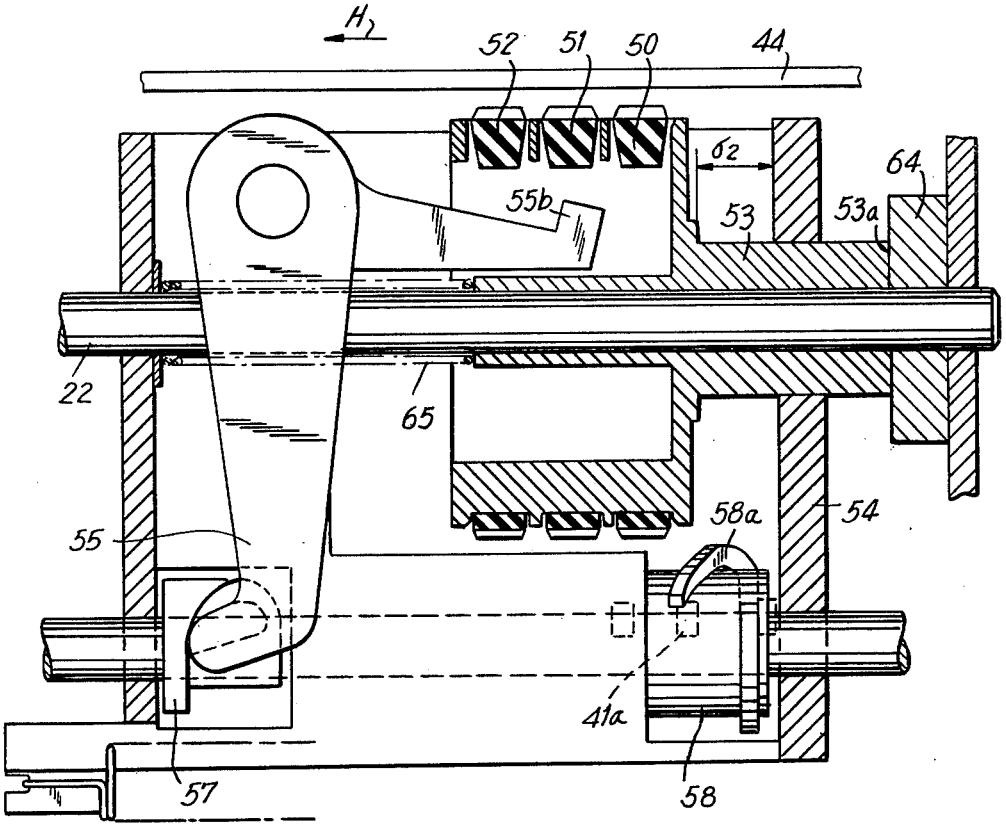
FIG. 8 is a top view of a state of the carriage in selecting for a second character position.

When the shifting cam 58 is moved this way, simultaneously the carriage frame 54, the printing cam 57 and the hammer 55 are also moved. Since the gap δ1 is provided between the type holder 53 and the carriage frame 54 as shown in FIG. 1, while the carriage frame 54 is moved, the portion 53*a* of the type holder 53 is maintained abutted against the carriage stop 64 as shown in FIG. 8. In this case, the portion 55*b* of the hammer 55 confronts the type belt 51. When the printing switching cam 11 has turned through about 330°, the pawl 12*a* confronts the cut 11*b*. Therefore, the selection pawl 12 is turned in the direction of the arrow B by action of the spring 20 to again lock the printing switch cam 11. Thus, the place shifting operation has been completed. When the cut 11*b* arrives, the protrusion 11*d* of the cam 11*e* of the printing switching cam 11 engages with the pawl 12*b* to facilitate the action of the spring 20 and to thereby turn the selection pawl 12 in the direction of the arrow B.

(4) Second Place Selection

Simultaneously when the selection pawl 12 turns in the direction of the arrow B to lock the printing switching cam 11, the pawl 12*c* is disengaged from the selection ratchet 21*b*. Thus, as was described with reference to the first place selection in detail, the selection gear 21 is turned again, to select a desired type element. The second place selection is different from the first place selection in that, while in the first place selection a desired type element is selected out of the font of type elements on the type belt 50, for the second place selection a desired type element is selected out of the font of type elements on the type belt 51.

(5) Second Place Printing and Shifting

Second place printing is carried out similarly to the above-described first place printing with the following exception: For the first place printing, printing is carried out by pushing the type belt 50 outwardly against the platen 44. However, for the second place printing, printing is carried out by pushing the type belt 51 outwardly against the platen 44. Similarly, as in the first place shifting, the second place shifting is achieved when the cam 58*a* of the shifting cam 58 is engaged with the tooth 41*a* of the positioning plate 41 so that the carriage 3 is moved in the direction of the arrow H by the cam lead. However, it should be noted that, as the gap δ2 between the type holder 53 and the carriage frame 54 is slightly smaller than the shifting pitch, the type holder 53 is moved slightly in the direction of the arrow H being abutted against the carriage frame 54 as a result of which the portion 55*b* of the hammer 55 confronts the type belt 52 (FIG. 9).

(6) Third Line Selection

Figure 9:
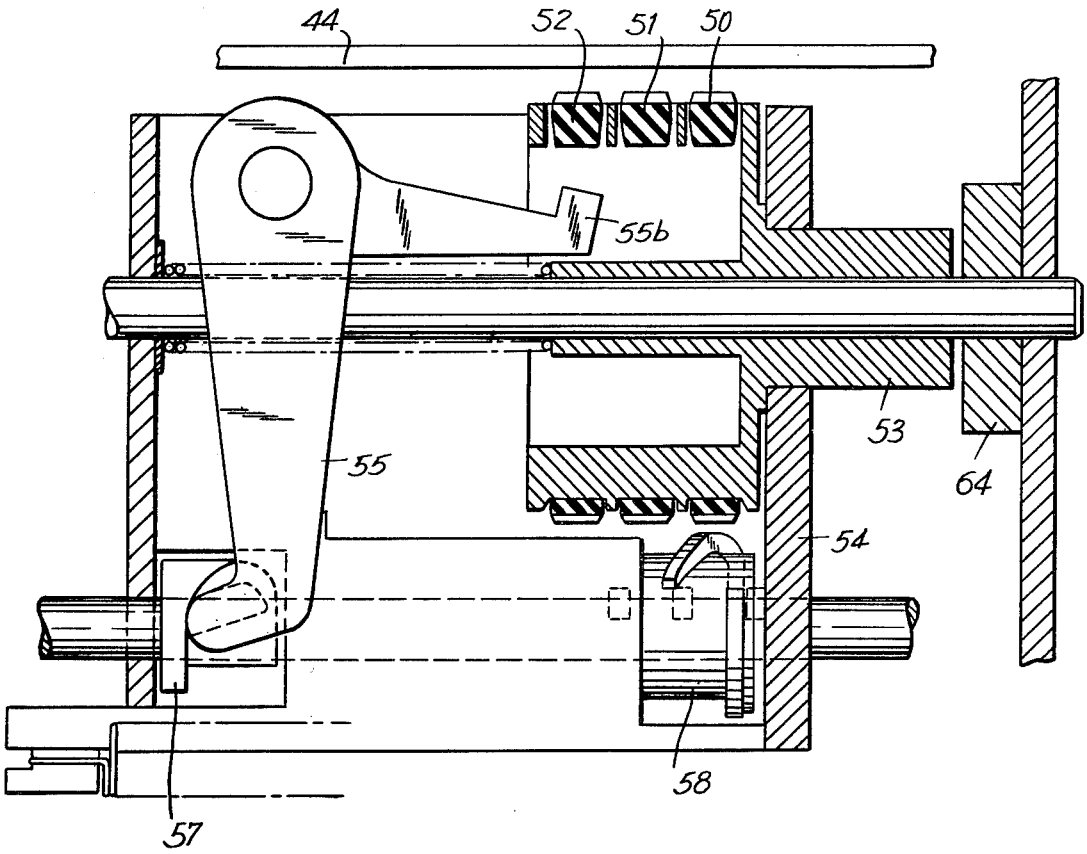
FIG. 9 is a top view of a state of the carriage in selecting a third character position.

Third place selection is carried out similarly to second place selection except for that second place selection, a desired type element is selected from the font of type elements on the type belt 51, while for third place selection, a desired type element is selected from the font of type elements on the type belt 52 (FIG. 9).

(7) Printing and Shifting of Third Place

Printing is carried out similarly to printing of the second place with the exception that type elements which are pushed outwardly against the platen 44 are selected from the font of type elements on the type belt 52. Shifting is also carried out similarly to the case of the second place except that the carriage 3 is moved by a distance corresponding, to one column. However, in this case the type holder 53 has been abutted against the carriage frame 54 and therefore the carriage 3 is moved as shown in FIG. 9 with the portion 55*b* of the hammer 55 confronting the type belt 52.

(8) Selection, Printing and Shifting of Forth Place and So Forth

These operations are carried out by repeating the procedures described in the above paragraphs (6) and (7).

(9) Highest Place Selection and Printing, and Sheet Feeding and Carriage Return

The timing for these operations is as indicated by the two-dot chain lines in FIG. 7.

Selection is carried out as described above although in the case of the highest place, application of current to the coil is not immediately suspended. That is, the application of current is maintained until the printing switching cam 11 has turned through about 145° as indicated by the two-dot chain line in the waveform 101 of FIG. 7. When the printing switching cam 11 has turned through 100°, the cut 11*h* of the cam 11*f* confronts the portion 13*a* of the positioning lever 13. In this operation, as the application of current to the coil 29 is continued, the trigger lever 23 is in operation as indicated by the two-dot chain lines in FIGS. 2, 3 and 7. Therefore, the positioning lever 13 is turned in the direction of the arrow D by a spring (not shown) as indicated by the two-dot chain line in FIG. 3. As the positioning lever 13 is turned this way, the sheet feeding trigger lever 33 is turned in the direction opposite to the direction of the arrow E by the portion 13*d* of the positioning lever 13 so that the portion 33*b* is disengaged from the portion 35*a* of the sheet feeding clutch pawl 35.

Upon disengagement, the sheet feeding clutch pawl 35 is turned in the direction of arrow F by the action of the spring 40 so that the pawl 35*b* is engaged with the tooth 37*b* of the sheet feeding clutch ratchet 37*a* (indicated by the two-dot chain line in FIG. 3). In this operation, as the rotation of the type shaft 22 has been stopped, the rotation of the clutch ratchet 37*a* is also stopped. However, the tooth 37*b* is so arranged that it confronts the type element 50*a* on the type belt 50 and engages the pawl 35*b* when stopped. Therefore, the pawl 35*b* is engaged with the tooth 37*b*. When the printing switching cam 11 is further turned, the positioning lever 13 is returned to the standby position by being turned in the direction opposite to the direction of the arrow D by the cam lead 11*i* of the cam 11*f*. The sheet feeding trigger lever 33 is turned in the direction of the arrow E by the spring 36. However, as the sheet feeding clutch pawl 35 is operating, the trigger lever 33 is stopped with the portion 33*b* abutted against the portion 35*c* of the sheet feeding clutch pawl 35.

Carriage return is carried out as follows. When the positioning lever 13 is turned in the direction of the arrow D, the protrusions 13*e* and the recesses 13*f* of the positioning lever 13 confront the recesses 34*d* and the protrusions 34*a* of the positioning transmission lever 34, respectively. When the printing switching lever 11 is turned through 145°, the lead of the end face cam 15*a* of the printing gear 15 moves away. Therefore, the positioning transmission lever 34 is moved in the direction of the arrow G by the action of the spring 42 and the protrusions 13*e* and the recesses 13*f* of the positioning lever 13 are engaged with the recesses 34*d* and the protrusions 34*a* of the positioning transmission lever 34, respectively, as indicated by the soid line in FIG. 5.

When the printing switching cam 11 turns through about 190°, the positioning lever 13 is returned to the standby position by being turned in the direction opposite to the direction of the arrow D by the cam lead 11*i*. In this operation, the positioning transmission lever 34 is turned in the direction opposite to the direction of the arrow D due to engagement with the positioning lever 13, while the positioning plate 41 is turned in the direction opposite to the direction of the arrow Q due to engagement with the portion 34*c* of the positioning transmission lever 34, as a result of which the cam 58*a* of the shifting cam 58 is maintained disengaged from the tooth 41*a* of the positioning plate 41 (the two-dot chain line in FIG. 10). Upon disengagement of the positioning plate 41 from the cam 58, the carriage 3 is returned to the standby position (the first place) by action of the return spring 63. Upon suspension of the application of current to the coil 29, the trigger lever 23 is returned to the standby position by action of the spring 25.

When the type shaft 22 starts rotation again after the printing switching cam 11 has made one complete revolution, the sheet feeding clutch ratchet 37*a* is also turned. In this case, as the pawl 35*b* of the sheet feeding clutch pawl 35 is engaged with the tooth 37*b*, the sheet feeding drive gear 38, whose shaft 38*b* pivotally supports the sheet feeding clutch pawl 35, is turned in the direction of the arrow R. As the sheet feeding drive gear 38 is turned this way, the portion 33*b* of the sheet feeding trigger lever 33 is abutted against the periphery 38*c* of the sheet feeding drive gear 38. When the sheet feeding drive gear 38 has made one complete revolution, the portion 33*b* of the sheet feeding trigger lever 33 is again engaged with the portion 35*a* of the sheet feeding clutch pawl 35, the sheet feeding clutch pawl 35 is disengaged from the sheet feeding clutch ratchet 37*a*, and rotation of the sheet feeding drive gear 38 is stopped. The rotation of the sheet feeding drive gear 38 is transmitted through the sheet feeding transmission gear 39 to turn the sheet feeding gear 47, the sheet feeding shaft 48 and the sheet feeding roller 49, so that the printing sheet 45 is fed by a distance of one line by the sheet feeding roller 49.

For printing the next line, the procedures described in paragraphs (2) through (3) above are carried out again.

If, in the case where the printing device is utilized for a portable electronic computer, symbols are provided on the type belts 50 and 51 and numerals on the type belt 52, then symbols can be printed at the first and second places and numerals at the third place and so forth.

As is apparent from the above description, the invention provides the following effects or merits:

(1) Selection, printing, shifting, sheet feeding and carriage return can be readily switched by a simple method in which one motor and one electromagnetic member are used to control the engagement of the electromagnetic trigger member and the switching member (the positioning lever 13). Accordingly, the number of components forming the printing device is greatly reduced compared with the prior art, and accordingly, the number of steps needed for assembly of the device is reduced. Futhermore, the control circuit for controlling the printing device can be simplified. As only one electromagnetic member is employed for the driving operation, the number of drivers can be decreased. Therefore, the printing device has small size, small weight, and low manufacturing cost. Accordingly, when this printing device is combined with a portable electronic computer, the overall assembly is small and light, and it can be manufactured at low cost.

(2) Only the type member and the printing mechanism are born by the carriage while the selection and drive mechanisms are mounted on the main frame of the printing device. Therefore, the carriage can be made small and light, and accordingly, the printing device can easily be miniaturized. A very simple method is used in which type belts are employed as the type member is such a manner that, for the first place, the type belt holder is abutted against the frame, and for the second place and so on, the holder is abutted against the carriage so that the hammer is selectively confronted with the type belts. Therefore, printing is carried out without increasing the size of the type belts, and the number of type elements can readily be increased. As the planet gear mechanism and the electromagnetic brake are employed for the electromagnetic operator for the selection mechanism, the power consumption of the electromagnetic device is reduced, and the electromagnetic device can be miniaturized. As cam means is provided which operates in association with the spring member which returns the selection pawl from the operating position to the standby position, the load applied to the electromagnetic operator when selection is carried out is reduced, and the size and power consumption of the electromagnetic operator further reduced.

(3) The selecting operation and the printing operation can be switched by a simple construction in which the locking member (the selection pawl 12), having a pair of locking pawls for alternately catching and locking two outputs of the differential mechanism, is provided in the selection mechanism. The control member (the cam 11*c* of the printing switching cam 11), for holding the locking member so that the latter is maintained operated by the electromagnetic trigger member during printing operations and shifting operations, is provided at the second output side connected to the printing mechanism so that, after printing and shifting operations, the locking member is returned to the standby position to again catch and lock the second output. Therefore, the number of components forming the printing device is reduced and the size and weight of the printing device decrease. The printing device of the invention can be readily combined with a portable electronic computer. As the application of current to the electromagnetic trigger member can be suspended immediately upon the second output side starting rotation, the power consumption is reduced.

(4) Only the printing mechanism, the type members, and the shifting cam, which is the shifting drive member of the shifting mechanism, are mounted on the carriage. Therefore, the size of the carriage is small, and accordingly, its weight is very small thus contributing to a reduction of the size and the weight of the printing device. As the differential mechanism for switching the selecting and printing operations is mounted on the frame, the construction thereof is considerably simple. This results in a reduction of the size and weight of the printing device. The type members are connected to one output of the differential mechanism, and the printing mechanism and the shifting mechanism are connected to the other output. Therefore, the printing device can be controlled by one electromagnetic device, thereby contributing to a simplification of the construction.

(5) The construction is simple, in that the type members are provided on the carriage in such a manner that they are movable by a predetermined distance, and the hammer confronts the type belts successively in such a manner that, in the standby state of the printing device, the type member is abutted against the frame and the hammer is confronted with the first type belt. After the shifting operation is carried out for one line, the hammer is confronted with the second type belt. The operation is continued in this manner. That is, the type belts are switched until the type member abuts against the carriage. Thus, the member of type elements can be increased without decreasing the printing speed and without increasing the size of the type member.

A description follows of an alternative embodiment of a printing device in accordance with the invention.

Figure 11:
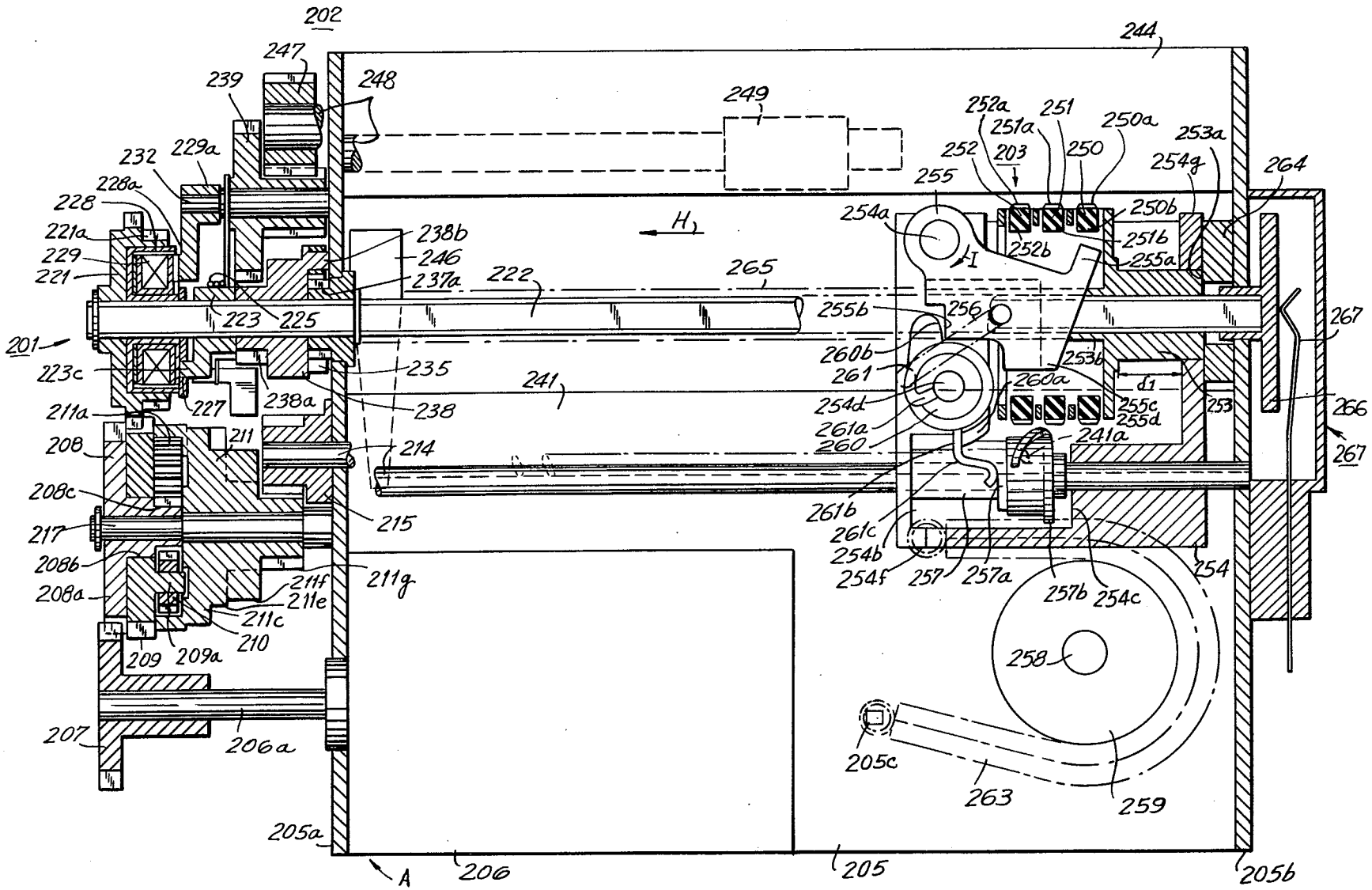
FIG. 11 is a sectional plan view of an alternative embodiment of a printing device in accordance with the invention.

As shown in FIG. 11, a printing device of the present invention generally comprises an assembly 201 of conversion and selection mechanisms, an assembly 202 of sheet feeding and carriage returning mechanisms, and a carriage 203. There mechanisms will each be described below with reference to FIGS. 11 through 14.

(1) Conversion and selection mechanisms

A channel-shaped frame 205 includes a pair of frame members 205*a*, 205*b* spaced from each other. A motor 206 is affixed to the frame member 205*a* and has a motor shaft 206*a* to which there is secured a gear 207. A speed reduction gearing 208 includes a gear 208*a* meshing with the motor gear 207, a gear shaft 208*b* on which there is journalled a selection drive gear 209, and a sun gear 208*c* held in mesh with a planet gear 210. The selection drive gear 209 has a shaft 209*a* on which the planet gear 210 is journalled. A printing switching cam 211 is composed of an internal gear 211*a* meshing with the planet gear 210, a cam 211*c* having in its outer periphery a recess 211*b* in which there is engageable a pawl 212*a* of a selection pawl 212 (FIGS. 12 and 14) that serves as a locking member, a cam 211*e* serving as a return drive member and having on its outer periphery a protrusion 211*d* that is engageable with a pawl 212*b* of the selection pawl 212, a cam 211*f* serving as a first control member and engageable with a portion 213*a* of a return lever 213 (FIGS. 13 and 14) which serves as a switching member, and a gear 211*g* held in mesh with a printing gear 215 fixed to a printing shaft 214 at a gear ratio of 1:1.

The speed reduction gearing 208 and the printing switching cam 211 are rotatably mounted on a shaft 217 affixed to the frame member 205*a*. A conversion mechanism is constituted by a differential mechanism which is in the form of a planetary gear composed of the sun gear 208*c*, the planet gear 210, the internal gear 211*a*, and the selection drive gear 209. A selection gear 221, which is held in mesh with the selection drive gear 209, has a selection ratchet wheel 221*a* having teeth arranged at regular intervals around its outer periphery, the selection pawl 212 having a pawl 212*c* engageable with the teeth. The selection gear 221 is fixed to an end of a type shaft 222 projecting from the frame member 205*a*, the type shaft 222 being supported on and between the frame members 205*a*, 205*b*. An electromagnetic clutch yoke 228 of magnetic material is fitted in the selection gear 221. The yoke 228 has an opening 228*a* in which there is disposed a coil 229 with a member 229*a* thereof affixed to a shaft 232 secured to the frame member 205*a*, the opening 228*a* being directed to a trigger plate 227 of magnetic material.

Figure 12:
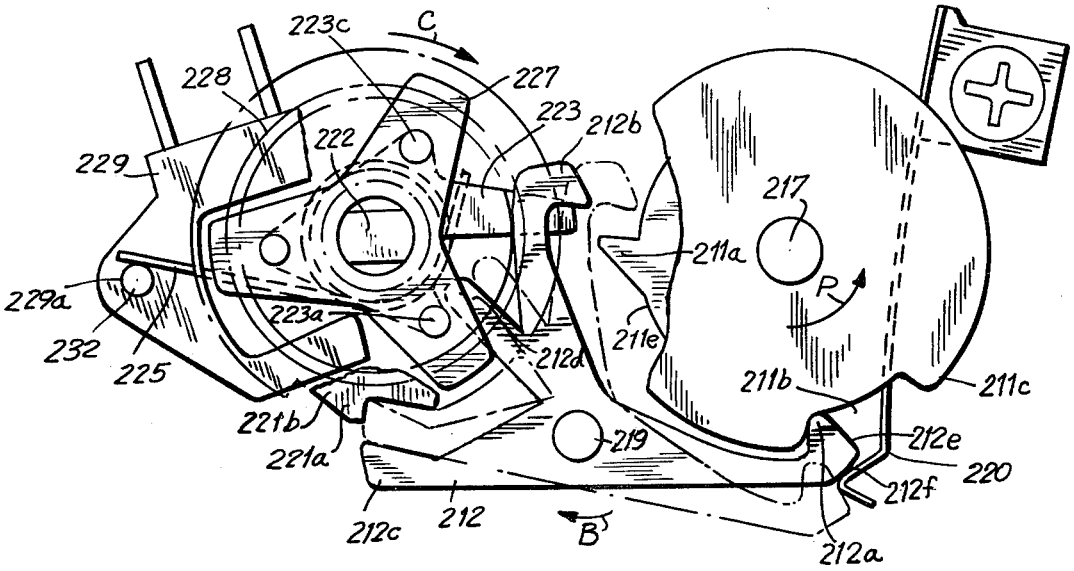
FIG. 12 is a side elevational view of a conversion and selection mechanism for the printing device of FIG. 11.

A trigger lever 223 includes a portion 223*a* engageable with a portion 212*d* of the selection pawl 212, a portion 223*b* engageable with a portion 231*b* of the return lever 213, and pins 223*c* engaging in holes 227*a* in the trigger plate 227. The trigger lever 223 is fitted over the type shaft 222 and urged by a trigger lever spring 225 to turn in the direction of the arrow C in FIG. 14. An electromagnetic trigger member is constituted jointly by the electromagnetic clutch yoke 228, the coil 229, the trigger plate 227, the trigger lever 223, and the trigger lever spring 225. The selection pawl 212 is rotatably mounted on an end of a shaft 219 projecting from the frame member 205*a*, the shaft 219 extening through the frame members 205*a*, 205*b*. The selection pawl 212 has slanted surfaces 212*e*, 212*f* which are engageable with a selection pawl spring 220 which is in the form of a leaf spring affixed to the frame member 205*a* and serves as an action member. The slanted surfaces 212*e*, 212*f* are selectively engageable with the spring 220 to allow the selection pawl 212 to take one of the solid-line position (standby condition) and the two-dot-and-dash-line position (operating condition) as shown in FIG. 12.

The assembly 201 of conversion and selection mechanisms is thus constructed.

(2) Sheet feeding and carriage returning mechanism

Figure 13:
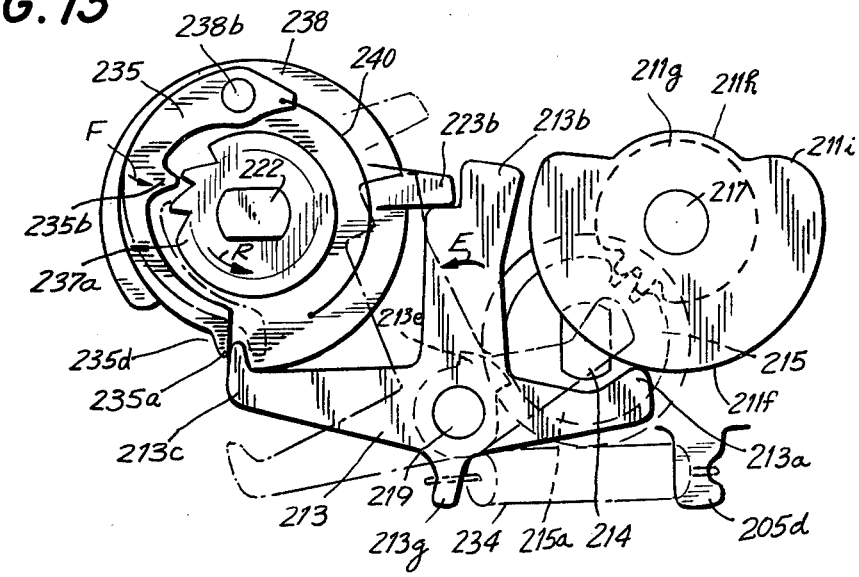
FIG. 13 is a side elevational view of sheet feeding and carriage returning mechanisms for the printer of FIG. 11.
Figure 14:
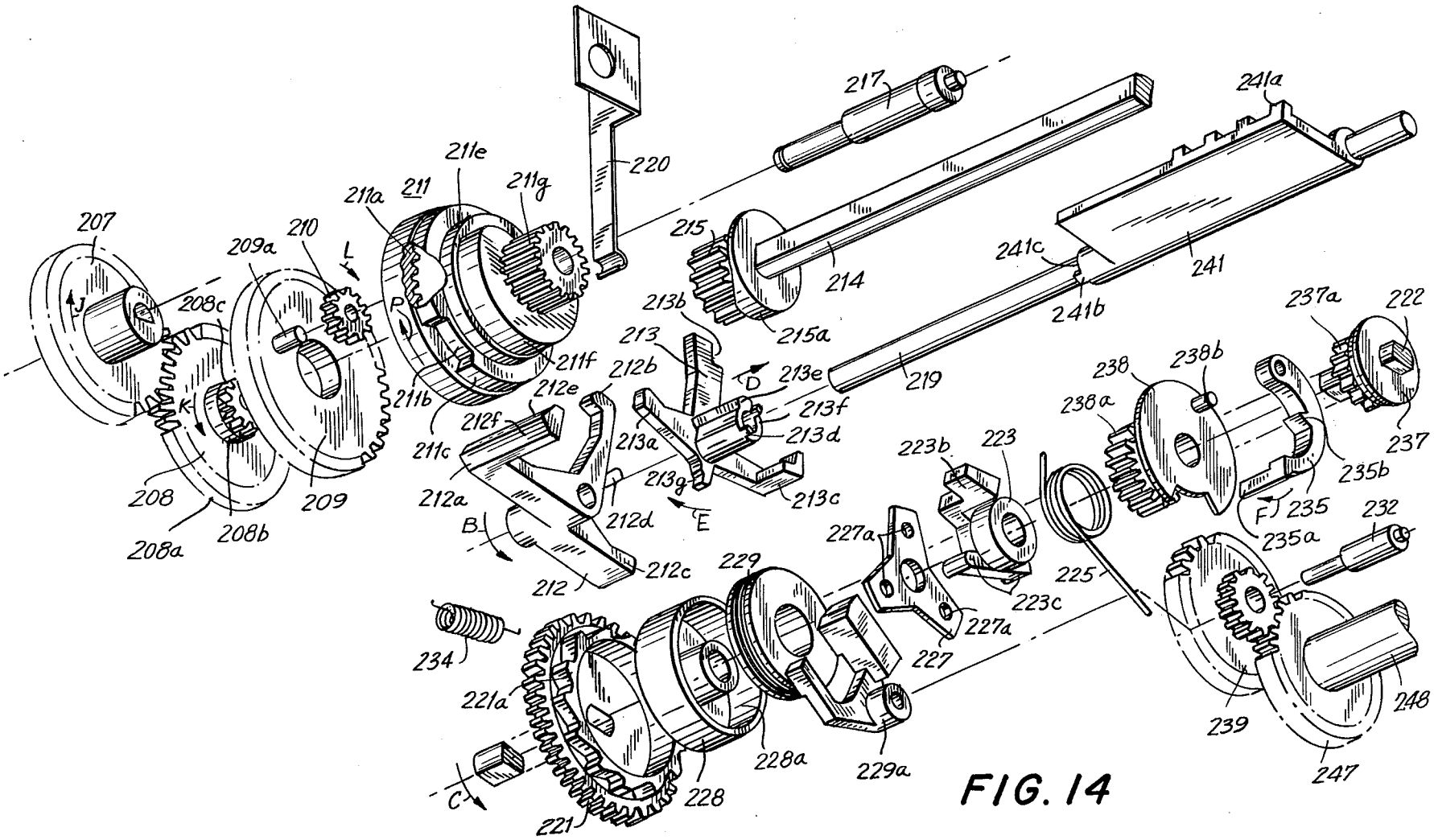
FIG. 14 is an exploded perspective view of the conversion and selection mechanisms and the sheet feeding and carriage returning mechanisms as viewed in the direction of the arrow A in FIG. 11.
Figure 15:
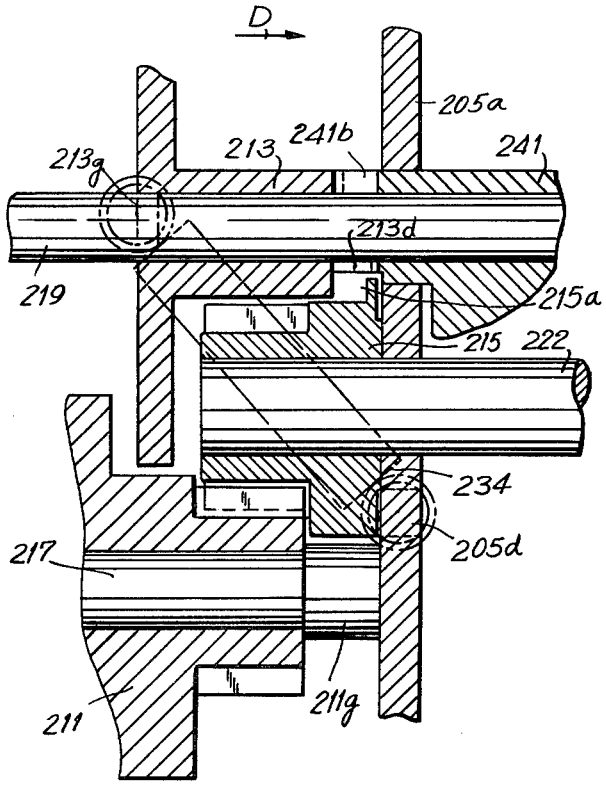
FIG. 15 is a fragmentary horizontal cross-sectional view of the carriage returning mechanism for the printer of FIG. 11.

The return lever 213 comprises the portion 213*a* engageable with the cam 211*f* of the printing switching cam 211, the portion 213*b* engageable with the portion 223*b* of the trigger lever 223, a portion 213*c* engageable with a portion 235*a* of a paper feeding clutch pawl 235, a projection 213*d* engageable with a projection 241*b* of a positioning plate 241, and a portion 213*e* engageable with an end cam surface 215*a* of the printing gear 215 which serves as a second control member. The return lever 213 is rotatably mounted on the shaft 219. A return lever spring 234 acts between a portion 213*f* of the return lever 213 and a projection 205*d* of the frame member 205*a*, as shown in FIG. 13, to urge the return lever 213 in the direction of the arrows D and E as illustrated in FIG. 14. The sheet feeding clutch pawl 235 is swingably mounted on a pin 238*b* of a sheet feeding drive gear 238 which has a gear 238*a* meshing with a sheet feeding transmission gear 239 and which is rotatably mounted on the type shaft 222. The sheet feeding clutch pawl 235 is urged to turn in the direction of the arrow F by a spring 240 having one end fixed to the sheet feeding drive gear 238. The sheet feeding clutch pawl 235 also has a pawl 235*b* engageable with teeth 237*a* arranged at regular intervals around an outer periphery of a clutch ratchet wheel 237. A sheet feeding gear 247 is affixed to a shaft 248 on which a sheet feeding roller 249 is fixedly mounted, and is held in mesh with the sheet feeding transmission gear 239 rotatably mounted on a shaft 232.

The assembly 202 of sheet feeding and carriage returning mechanisms is thus constructed.

(3) Carriage

A type belt 250 having type elements 250*a* on its outer side and protrustions 250*b* on its inner side, a type belt 251 having type elements 251*a* and protrusions 251*b*, and a type belt 252 having type elements 252*a* and protrusions 252*b* are mounted on a type holder 253 which is mounted slidably and non-rotatably on the type shaft 222. The type holder 253 is in the form of a cylinder having in an outer wall thereof holes in which are loosely fitted the protrusions 250*b*, 251*b* and 252*b* of the type belts 250, 251 and 252. The type belts 250, 251 and 252 are elastic bodies and made of, for example, rubber. The type holder 253 is held on a carriage frame 254 in such a manner as to be movable a predetermined distance and is urged by a spring 265 in the direction which is opposite to that of the arrow H as shown in FIG. 11. A carriage frame 254 is guided by the type shaft 222 and the printing shaft 214, and is movable in the direction of the arrow H.

Figure 16:
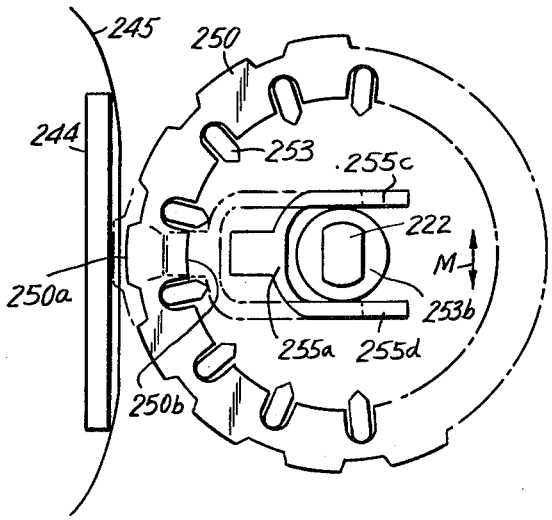
FIG. 16 is a vertical cross-sectional view of a type member for the printer of FIG. 11.

A hammer 255 is rotatably mounted on a shaft 254*a* mounted on the carriage frame 254 and is urged by a spring 256 in the direction of the arrow I. The hammer 255 has one end 255*a* engageable with the protrusion 250*b*, 251*b* or 252*b* of the type belt 250, 251 or 252. The hammer 255 has another end 255*b* held in engagement with a portion 260*b* of a transmission lever 260 rotatably supported on a shaft 254*d* mounted on the carriage frame 254, there being a limiter spring 261 having one end 261*a* fixed on the other end 261*b* movably held by a portion 260*a*. As shown in FIG. 16, the hammer 255 is limited by portions 255*c*, 255*d* thereof and a portion 253*b* of the type holder 253 in its movement in the direction of the arrow M. The limiter spring 261 has a portion 261*c* held in engagement with an end cam surface 257*a* of a type position shifting cam 257 sandwiched between portions 254*b*, 254*c* of the carriage frame 254 and slidably and nonrotatbly mounted on the printing shaft 214. The type position shifting cam 257 also has an elongate cam 257*b* extending peripherally therearound and held in engagement with a tooth 241*a* of the positioning plate 241.

The carriage 203 is thus constructed.

Operation of the printing device thus assembled with now be described.

(1) Initial setting

Initial setting is carried out before selection and printing are started. The cam 257*b* of the type position shifting cam 257 is disengaged from the tooth 241*a* of the positioning plate 241 as shown by the two-dot-and-dash lines in FIG. 20 in a manner described later. The carriage 203 is caused to move in the direction which is opposite to that of the arrow H as shown in FIG. 11 under the resiliency of a return spring 263 which extends around a spring guide roller 259 rotatably mounted on a shaft 258 and which has one end affixed to a portion 254*f* of the carriage frame 254 and the other end secured to a portion 205*c* of the frame 205. The carriage 203 is resiliently urged by the spring 263 until a portion 254*g* of the carriage frame 254 abuts against a carriage stopper 264 fixed to the frame member 205*b* as shown in FIG. 11. When the portion 254*g* is held against the carriage stopper 264, the type holder 253 has its portion 253*a* held against the carriage stopper 264 under the force of the type spring 265. In this position, the end 255*a* of the hammer 255 is located in confronting relation to the type belt 250 as illustrated in FIG. 11. With the slanted surface 212*f* of the selection pawl 212 being held in engagement with the selection pawl spring 220, the pawl 212*a* of the selection pawl 212 engages in the recess 211*b* in the cam 211*c* and the pawl 212*c* held out of engagement with a tooth 221*a* of the selection ratchet wheel 221, as shown by the solid lines in FIG. 12. The trigger lever 223 has its portion 223*b* held against the portion 213*b* of the return lever 213 under the resiliency of the trigger spring 225 as illustrated by the solid lines in FIGS. 12 and 13.

(2) Selection of first type position

When the motor 206 rotates, the motor gear 207 is caused to rotate in the direction of the arrow J, whereupon the speed reduction gear 208 and the planet gear 210 are caused to rotated respectively in the directions of the arrows K and L, as shown in FIG. 14. At this time, the printing switching cam 211 remains locked by the pawl 212*a*, and the internal gear 211*a* is prevented from rotating. Thus, the planet gear 210 rotates about its own axis as it revolves around the sun gear 208*c*, causing the selection drive gear 209 to rotate in the direction of the arrow K through the planet gear shaft 209*a*. Rotation of the selection drive gear 209 causes the selection gear 221 to rotate in the direction opposite to that of the arrow C, whereupon the electromagnetic clutch yoke 228, the type shaft 222, and the type holder 253 are rotated.

A desired type element is selected by controlling energization of the coil 229 with a type position signal which is generated by a detector 267 (FIG. 11) that comprises a detection plate 266 affixed to the type shaft 222 and a brush 267 secured to the frame 205 for producing a type position signal in response to a type element 250*a*. The coil 229 is energized just before a desired type element reaches a position which confronts a platen 244 supported on and extending between the frame members 205*a*, 205*b*.

When the coil 229 is energized, the trigger plate 227 is attracted to the electromagnetic clutch yoke 228 and corotates therewith. As the trigger plate 227 starts rotating, the trigger lever 223 which is locked therewith by the pins 223*c* is caused to rotate in the direction that is opposite to the direction of the arrow C against the force of the trigger lever spring 225. Rotation of the trigger lever 223 causes its portion 223*a* to rotate the selection pawl 212 in the direction of the arrow B until the pawl 212*c* engages a tooth of the selection ratchet wheel 221*b*, whereupon the selection ratchet wheel 221*b* stops rotating as shown by the two-dot-and-dash lines in FIG. 12. When the selection ratchet wheel 221*b* is locked, the type shaft 222 and the type holder 253 stop rotating. A desired type element 250*a* is stopped in confronting relation to the platen 244. The first type position is thus selected as illustrated in FIG. 16.

(3) Printing at first type position and shifting to next type position

Concurrent with selection of the desired type element in response to rotation of the selection pawl 212 in the direction of the arrow B when the trigger lever 223 rotates, the pawl 212*a* is released out of engagement with the recess 211*b*, allowing the printing switching cam 211 to rotate freely. At this time, the selection ratchet wheel 221*b* is prevented by the pawl 212*c* from rotating, the selection gear 221 and the selection driver gear 209 stop rotating. Rotation of the planet gear 210 then causes the internal gear 211*a* and hence, the printing switching cam 211 to rotate in the direction of the arrow P as shown in FIGS. 11 and 12.

When the printing switching cam 211 rotates, the printing gear 215, the printing shaft 214, and the type position shifting cam 257 are caused to rotate. When the type position shifting cam 257 rotates, a cam lead of the end cam surface 257*a* causes the hammer 255 to turn in the direction that is opposite to that of the arrow I through the limiter spring 261 and the transmission lever 260. The end 255*a* of the hammer 255 is brought into engagement with one of the protrusions 250*b* on the type belt 250 to push the latter from inside until the type element 250*a* is pressed against the platen 244 with a sheet 245 of printing paper as illustrated by the two-dot-and-dash lines in FIG. 16. Although not shown, the type element 250*a* has its type surface coated with ink by an ink or the like in a known manner. At this time, the limiter spring 261 serves to press the type element 250*a* with a constant force even when the distance between the end 255*a* of the hammer 255 and the platen 244 changes due to variations in dimensional precision of parts. Furthermore, varying positions in which the type element 250*a* stops in its rotation can be corrected by the portions 255*c*, 255*d* of the hammer 255 and the portion 253*b* of the type holder 253, with the result that type elements are aligned with each other in the direction of a line.

Figure 17:
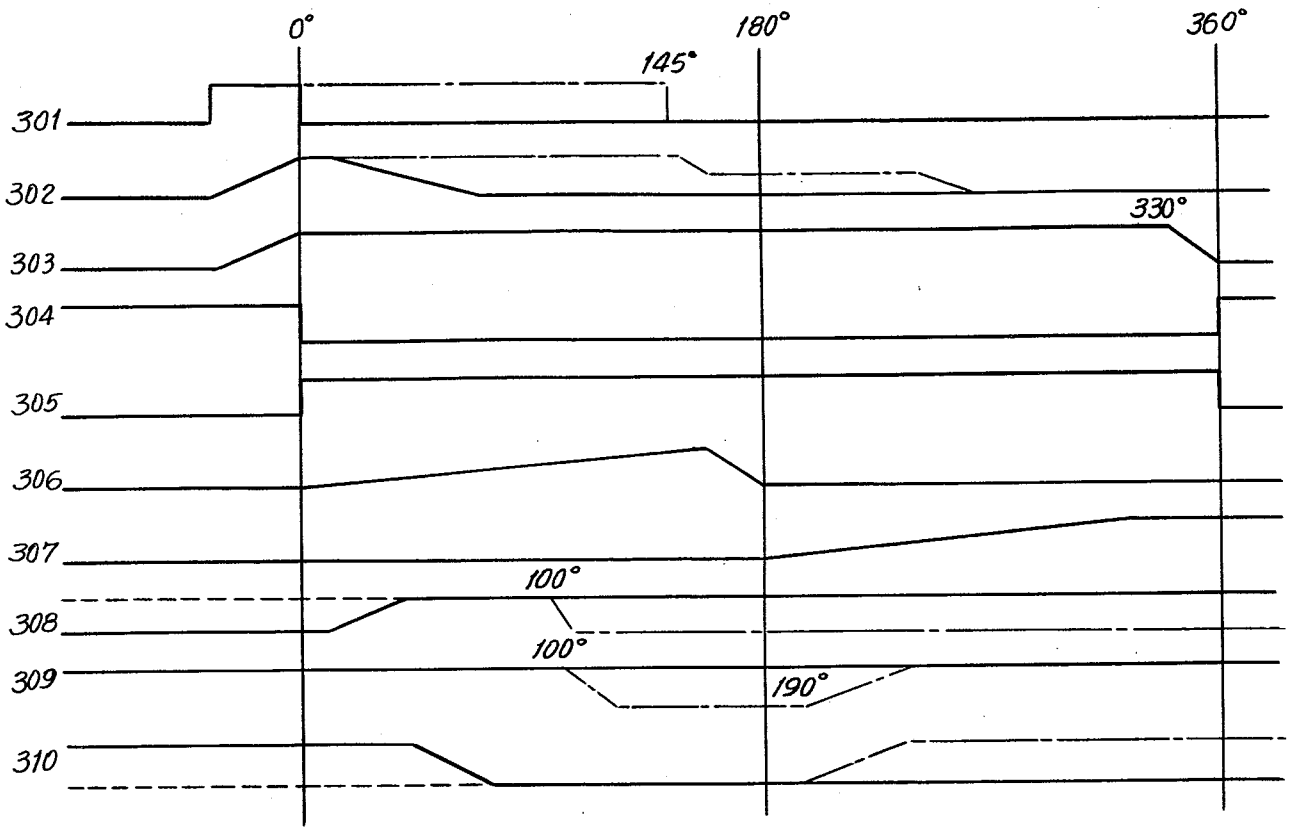
FIG. 17 is a timing chart illustrative of operation of parts of the printing device of FIG. 11.

FIG. 17 is a timing chart for operations of various parts while the printing switching cam 211 or the printing shaft 214 makes one revolution. Designated at wavefore 301 is energization of the coil 229, curve 302 indicates operation of the trigger lever 223, curve 303 indicates operation of the selection pawl 212, curve 304 indicates rotation of the type shaft 222, curve 305 indicates rotation of the printing switching cam 211 and the printing shaft 214, curve 306 indicates the cam lead of the cam surface 257*a* of the type position shifting cam 257, curve 307 indicates the cam lead of the cam surface 257*b* of the type position shifting cam 257, curve 308 indicates movement of the return lever 213 in the direction of the arrow D, curve 309 indicates angular movement of the return lever 213 in the direction of the arrow E, and curve 310 indicates movement of the positioning plate 241.

The coil 229 is de-energized (as shown by the solid line in FIG. 17) when the selection pawl 212 is brought into an operating condition (as shown by the two-dot-and-dash line), whereas the selection pawl 212 remains actuated by engagement between the slanted surface 212*e* and the selection pawl spring 220. Since the coil 229 is de-energized and the trigger plate 227 is rendered freely rotatable, the trigger lever 223 is caused by the trigger lever spring 225 to rotate in the direction of the arrow C into its standby condition as shown by the solid-line position in FIG. 12.

Immediately when the printing gear 215 starts rotating, the return lever 213 is caused by the end cam surface 215*a* on the printing gear 215 to move in the direction opposite to that of the arrow D, whereupon the projection 213*d* is moved out of engagement with a projection 241*b* of the positioning plate 241, which is then rotatable freely. The positioning plate 241 is now caused by the leaf spring 246 secured to the frame 205 to rotate in the direction of the arrow Q until the tooth 241*a* is brought into engagement with the cam surface 257*b* of the type position shifting cam 257 as shown by the solid-line position in FIG. 20.

Figure 18:
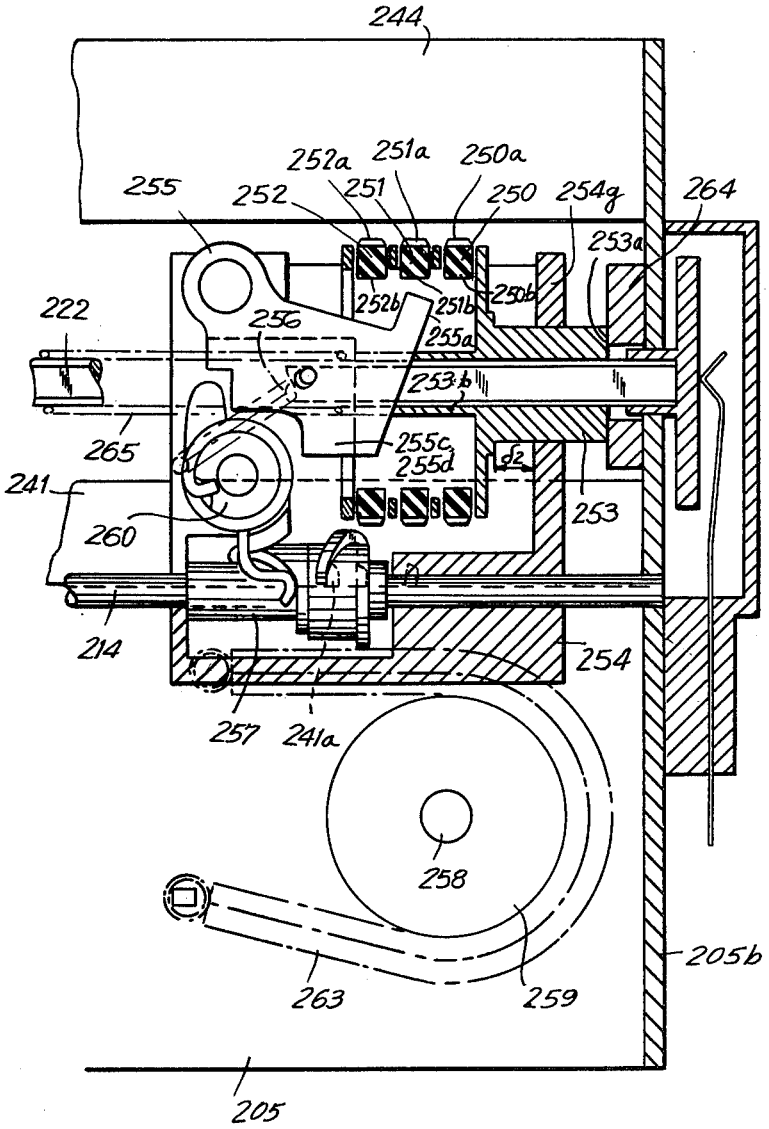
FIG. 18 is a fragmentary sectional plan view showing a carriage selecting a second type position for the printer of FIG. 11.

When the cam 211*f* of the printing switch cam 211 angularly moves through an angle of 100 degrees, the recess 211*h* confronts the portion 213*a* of the return lever 213, which is, however, prevented from rotating with the portion 213*b* locked by the portion 223*b* of the trigger lever 223 which has already been in the standby position. The return lever 213 is allowed to move in the direction of the arrow D since it is displaced out of engagement with the cam lead of the cam surface 215*a* of the printing gear 215. Since the positioning plate 241 has already rotated, the return lever 213 is stopped in a position in which an end surface of the projection 213*d* of the return lever 213 is held in abutting engagement with an end surface of the projection 241*b* of the positioning plate 241. When the printing shaft 214 angularly moves through an angle of 180 degrees to finish the printing operation and further angularly moves, the type position shifting cam 257 moves in the direction of the arrow H since the cam 257*a* of the type position shifting cam 257 engages the tooth 241*a* of the positioning plate 241. Movement of the type position shifting cam 257 causes the carriage frame 254 supporting the cam 257 to move therewith. With the type holder 253 having a portion spaced from the portion 254*g* of the carriage frame 254 by a clearance δ1 (FIG. 11), the carriage frame 254 is allowed to move, but the type holder 253 has its portion 253*a* held against the carriage stopper 264 under the force of the type spring 265 as shown in FIG. 18. At this time, the end 255*a* of the hammer 255 confronts the type belt 251. When the printing switching cam 211 rotates substantially through an angle of 330 degrees, the projection 211*d* of the cam 211*e* engages the pawl 212*b*, and the selection pawl 212 is caused to rotate in the direction opposite to that of the arrow B, locking the printing switching cam 211 again. Printing and shifting to a next type position are thus completed. At this time, the selection pawl 212 remains in the standby position (the solid-line position) due to engagement between the slanted surface 212*f* and the selection pawl spring 220.

(4) Selection of second type position

When the selection pawl 212 rotates in the direction that is opposite to that of the arrow B to lock the printing switching cam 211, the pawl 212*c* is simultaneously disengaged from the selection ratchet wheel 221*b*, and the selection gear 221 starts rotating again to select a desired type element in a manner similar to that described above in detail with respect to selection of the first type position. The selection of the second type position is different from the selection of the first type position in that, while in the first type position a desired type element is selected out of the font of type elements on the type belt 250, a desired type element is picked out of the font of type elements of the type belt 251 in the selection of the second type position (FIG. 18).

(5) Printing at second type position and shifting to next type position

The printing at the second type position is carried out in the same manner as that for the printing at the first type position. For the printing at the first type position, the type belt 250 is pushed outwardly against the platen 244. However, for the printing at the second type position, the type belt 251 is pressed outwardly against the platen 244 as shown in FIG. 18. Shifting to a next type position from the second type position is effected, as with the shifting from the first type position, by movement of the carriage frame 254 in the direction of the arrow H while the cam lead of the cam surface 257*b* of the type position shifting cam 257 is held in engagement with the tooth 241*a* of the positioning plate 241.

Figure 19:
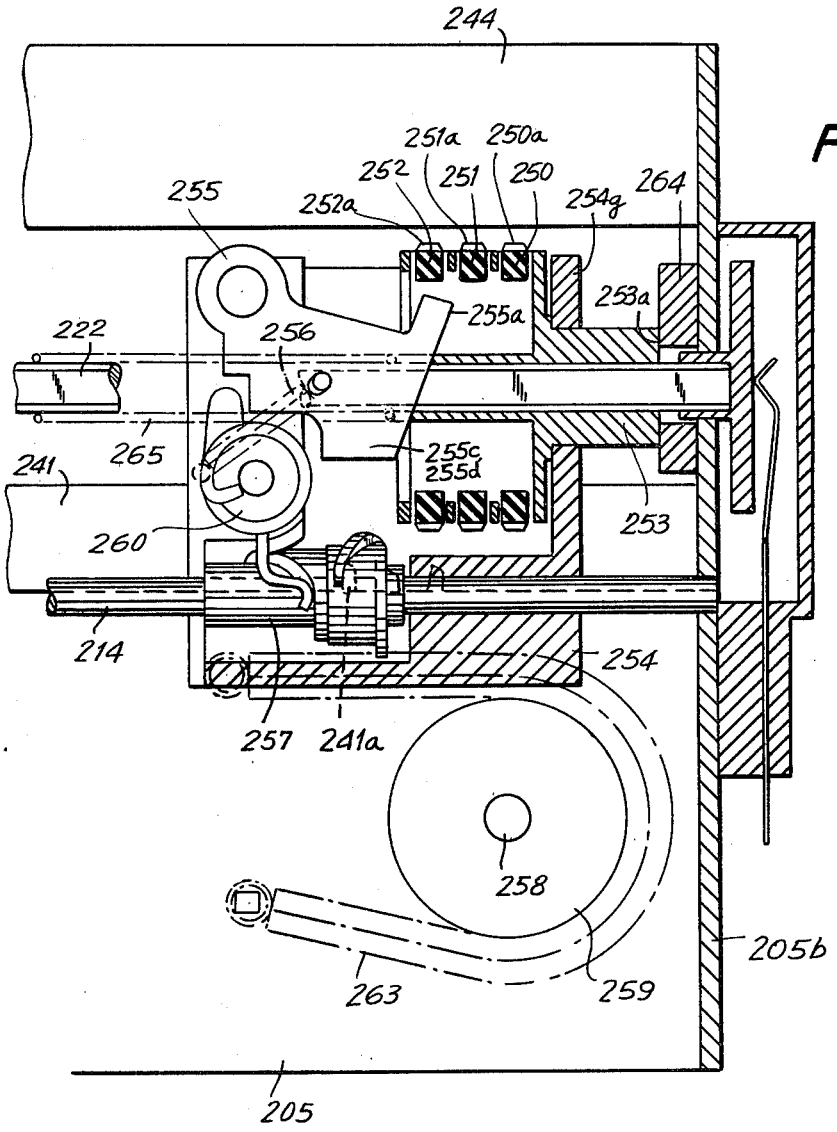
FIG. 19 is a fragmentary sectional plan view showing the carriage selecting a third type position for the printer of FIG. 11.

At this time, the type holder 253 has its portion spaced from the carriage frame portion 254*g* by a clearance $\delta_2$ which is slightly smaller than a shifting pitch. Therefore, the type holder 253 is pushed by the carriage frame 254 and caused thereby to move for a small distance in the direction of the arrow H, whereupon the end 255*a* of the hammer 255 is located in confronting relation to the type belt 252 as illustrated in FIG. 19. The printing gear 215 starts rotating to enable the cam 215*a* to move the return lever 213 in the direction opposite to that of the arrow D. However, such movement does not result in operation of the positioning plate 241 since the return lever 213 has already been released of engagement with the positioning plate 241.

(6) Selection of third type position

The third type position is selected substantially in the same manner as that for the selection of the second type position, except that, although a desired type element is selected out of the font on the type belt 251 in the second type position, a type element is picked out of the font on the type belt 252 in the third type position as shown in FIG. 19.

(7) Printing at third type position and shifting to next type position

The printing at the third type position is performed in a manner similar to that for the printing at the second type position. However, a type element which is to be pressed against the platen 244 is selected out of the font on the type belt 252. The shifting to a next type position from the third type position is substantially the same as that from the second type position, except that the carriage frame 254 is caused to move to the next type position together with the type holder 253 held in abutting engagement therewith with the parts arranged as shown in FIG. 19 and hence, the end 255*a* of the hammer 255 remains confronting the type belt 252.

(8) Selection of and printing at fourth type position and shifting to next type position and to higher type positions These operations can be effected by repeating the procedures (6) and (7).

(9) Selection of and printing at highest type position, and sheet feeding and carriage return The operations are effected in the patterns as shown by the two-dot-and-dash lines in the timing chart of FIG. 17. The selection of the highest type position is carried out in the same manner as before. However, in the highest type position, the coil 229 is not de-energized immediately, but remains energized as shown by the two-dot-and-dash line at curve 301 in FIG. 17 until the printing switching cam 311 angularly moves through an angle of 145 degrees. When the printing switching cam 211 turns through an angle of 100 degrees, the portion 213*a* of the return lever 213 faces the recess 211*h* in the cam 211*f*, and the return lever 213 is released of engagement with the cam 215*a* of the printing gear 215. At this time, the trigger lever 223 is kept actuated (as shown by the two-dot-and-dash lines in FIGS. 12, 13 and 17) since the coil 229 remains energized. Thus, the return lever 213 is caused by the return lever spring 234 to rotate in the direction of the arrow E as illustrated by the two-dot-and-dash lines in FIG. 13, and at the time to move in the direction of the arrow D.

Rotation of the return lever 213 disengages the portion 213*c* from the portion 235*a* of the sheet feeding clutch pawl 235. Upon being unlocked, the sheet feeding clutch pawl 235 is caused by the spring 240 to rotate in the direction of the arrow F until the pawl 235*b* engages a tooth 237*a* of the sheet feeding clutch ratchet wheel 237 as shown by the two-dot-and-dash lines in FIG. 13. At this time, the sheet feeding clutch ratchet wheel 237 is prevented from rotating since the type shaft 222 stops rotating. Since the tooth 237*a* is positioned so as to correspond to the type element 250*a* on the type belt 250 and to mesh with pawl 235*b* in the stopped position, the tooth 237*a* and the pawl 235*b* are held in mesh with each other. When the printing switching cam 211 angularly moves through an angle of 190 degrees, the return lever 213 is caused by the cam lead 211*i* of the cam 211*f* to rotate in the direction opposite to that of the arrow E into the standby condition. Since the sheet feeding clutch pawl 235 has been actuated, the portion 213*c* return toward the portion 235*d* of the sheet feeding clutch pawl 235, keeping the latter actuated.

Carriage return is effected as follows: When the return lever 213 angularly moves in the direction of the arrow E and moves in the direction of the arrow D, the projection 213*d* and the recess 213*f* of the return lever 213 are brought respectively into engagement with the recess 241*c* and the projection 241*b* of the positioning plate 241. When the printing switching cam 211 angularly moves through an angle of 190 degrees, the return lever 213 is caused by the cam lead 211*i* to return in the direction opposite to that of the arrow E and to return into the standby position.

Figure 20:
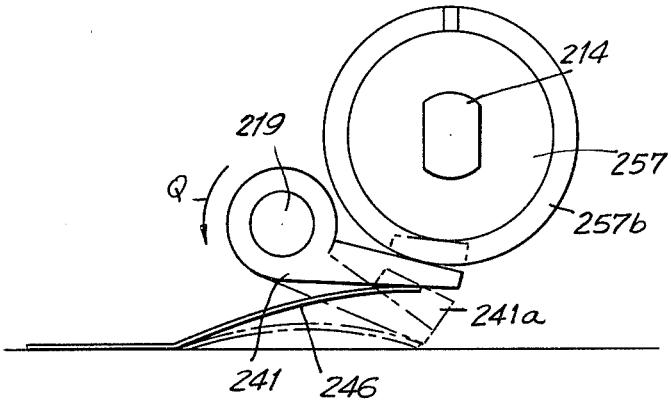
FIG. 20 is a vertical cross-sectional view of a type position shifting mechanism for the printer of FIG. 11.

At this time, the positioning plate 241 which engages the return lever 213 is rotated in the direction opposite to that of the arrow Q, and then is maintained in a position in which the cam 257*b* of the type position shifting cam 257 is disengaged from the tooth 241*a* of the positioning plate 241 as shown by the two-dot-and-dash lines in FIG. 20. When the positioning plate 241 is brought out of engagement with the type position shifting cam 257, the carriage 203 is caused by the return spring 263 to move back to the standby condition at the first type position.

When the coil 229 is de-energized, the trigger lever 223 is returned to the standby position under the resiliency of the trigger lever spring 225. When the printing switching cam 211 makes one revolution starting rotation of the type shaft 222 again, the sheet feeding clutch ratchet wheel 237 is also rotated. Since the pawl 235*b* of the sheet feeding clutch path 235 engages the tooth 237*a* at this time, the sheet feeding clutch pawl 235 and the sheet feeding drive gear 238 with the sheet feeding clutch pawl 235 swingably supported on the pin 238*b* are caused to rotate in the direction of the arrow R. When the sheet feeding drive gear 238 makes one revolution, the portion 213*c* of the return lever 213 engages the portion 235*a* of the sheet feeding clutch pawl 235 again, whereupon the sheet feeding clutch pawl 235 is disengaged from the sheet feeding clutch ratchet wheel 237, stopping rotation of the sheet feeding drive gear 238. Rotation of the sheet feeding drive gear 238 enables the sheet feeding transmission gear 239 to rotate the sheet feeding gear 247, the sheet feeding shaft 248, and the sheet feeding roller 249, thereby feeding the sheet 245 of printing paper by a distance corresponding to one line.

Printing along the next line can be performed by repeating the procedures (2)-(9).

Where the printing device of the invention is incorporated in an electronic desktop calculator or the like, the type belts 250, 251 may have symbol types and the type belt 252 may have numerical types to print symbols at first and second type positions and numbers at a third and subsequent type positions on a sheet of printing paper.

With the arrangement of the present invention, as described above, the selection mechanism has the locking member (selection pawl 212) for alternately catching and locking two outputs from the conversion mechanism. The action member (selection pawl spring 220) maintains the locking member in either one of two states, that is, a standby condition and an operating condition. When the locking member is shifted from the standby condition to the operating condition by the electromagnetic trigger member, the locking member is kept in the operating condition by the action member. When printing and shifting are completed, the locking member is returned from the operating condition to the standby condition by the return drive member (protrusion 211*d* of the printing switching cam 211) supplied with the second output which is fed to the printing mechanism, whereupon the second output is caught and locked again, and the locking member is maintained in the standby position by the action member. The printing device of the present invention is of highly simple construction to effect selection and switching between types. The printing device is composed of a reduced number of parts, is small in size, lightweight, and applicable to pocke-size electronic calculators and the like. Since the electromagnetic trigger member can be deenergized immediately after the locking member has been shifted from the standby condition to the operating condition, the printing device of the invention consumes a reduced amount of electric power.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, of language, might be said to fall therebetween.

What is claimed is:

1. A printing device for printing on a recording medium, comprising:

a type member having a plurality of characters and symbols thereon, said characters and symbols being individually subject to positioning for printing by impact with said recording medium;

a carriage supported by a frame, said type member being supported on said carriage;

means for selection of characters and symbols on said type member for printing;

means for driving selected characters to said recording medium for impact therewith and recording thereon;

a motor operating said printing device;

switch means for alternately switching the output of said motor between said selection means and said driving and impact means, in a first mode said selection means being powered from said motor to position said characters and symbols subject to selection, in a second mode said means for driving and impact being powered from said motor to move selected characters to said medium for printing, said switch means including at least first, second and third gears, said first gear being driven by a rotating output of said motor and turning said second gear, said second gear engaging said third gear, and a first cam surface having a locking portion thereon, said first cam surface being connected to said third gear for rotation therewith, said second gear travelling around the toothed periphery of said third gear when said first cam surface is fixed in position, motor power being applied in said first mode to said selection means by said second gear travel, said third gear and said first cam surface rotating by action of said second gear when said first cam surface is free to rotate, motor power being applied in said second mode to said driving and impact means by rotation of said third gear;

pawl means, said pawl means when engaged with said locking portion holding said first cam surface and third gear in said fixed position, said pawl means when disengaged from said locking portion releasing said first cam surface and said third gear for said rotation in response to rotation of said second gear;

means for disengaging said pawl means from said locking portion in said first cam surface, said means for disengaging cooperating with said selection means to release said pawl means from said locking portion when a selection is made on said type member for printing.

2. A printing device as claimed in claim 1, wherein said carriage is adapted for lateral motion relative to said recording medium, and further comprising a shifting mechanism for moving said carriage in a direction for printing a line on said recording medium, and a feeding mechanism for advancing said recording medium for each line of printing thereon, and return means for returning said carriage to a standby position for the start of printing of each said line.

3. A printing device for printing on a recording medium as claimed in claim 2, wherein said sheet feeding mechanism is adapted to operate during said first mode of operation and said carriage shifting mechanism and carriage return mechanism operate during said second mode.

4. A printing device for printing on a recording medium as claimed in claim 2, wherein said means for disengaging said pawl means from said locking portion includes an electromagnetic trigger member, said electromagnetic trigger member, when activated cooperating with said means for disengaging said pawl means to drive said pawl means from said locking portion, said first mode being terminated and said second mode being initiated upon character or symbol selection, said selection being accommodated by selective actuation of said electromagnetic trigger member during said first mode.

5. A printing device for printing on a recording medium as claimed in claim 4, wherein said first, second and third gears are in a planetary configuration, said first gear being the sun gear, said third gear being an internal gear and said second gear being a planetary gear engaging with said first and third gears.

6. A printing device for printing on a recording medium as claimed in claim 4, wherein said electromagnetic trigger member includes a brake disk.

7. A printing device for printing on a recording medium as claimed in claim 4, wherein said electromagnetic trigger member includes a clutch disk.

8. A printing device for printing on a recording medium as claimed in claim 4, wherein said return means includes a return element and a third cam surface, said return element being engageable with said means for disengaging, said third cam surface being connected to said third gear for rotation therewith, said third gear having one portion of rotation for holding said return element and another portion of rotation for rendering said return element free, said means for disengaging when driving said pawl means being simultaneously released from said return element, said electromagnetic trigger member being activated until said rotation of said third gear causes said return element to disengage from said third cam surface, said carriage being returned to a standby position when said return element is disengaged.

9. A printing device for printing on a recording medium as claimed in claim 3, wherein said sheet feeding mechanism is adapted to operate during said first mode of operation and said carriage shifting mechanism and carriage return mechanisms operate during said second mode.

10. A printing device for printing on a recording medium as claimed in claim 9, wherein said means for driving selected characters to said recording medium for impact therewith includes a drive member acting directly on said type member, said type member, drive member and a portion of said shifting means being mounted on said carriage for movement therewith, said means for selection of characters and symbols and said switch means being mounted to said frame.

11. A printing device for printing on a recording medium, as claimed in claim 10, wherein said print drive member and said shifting portion are mounted for rotation with a common shaft driven by said motor in said second mode.

12. A printing device for printing on a recording medium as claimed in claim 1, wherein said locking portion is a notch in said first cam surface.

13. A printing device for printing on a recording medium as claimed in claim 1, wherein said first, second and third gears are in a planetary configuration, said first gear being the sun gear, said third gear being an internal gear and said second gear being a planetary gear engaged with said first and third gears.

14. A printing device for printing on a recording medium as claimed in claim 1, and wherein said switch means includes a second cam surface, said second cam surface being connected to said third gear for rotation therewith, and further comprising detent means, said detent means holding said pawl means in said engaged position from which said pawl means is disengaged from said locking portion by said means for disengaging, and holding said pawl means in a second position from which said pawl means is moved for engagement with said locking portion by said second cam surface when said second mode is terminated.

* * * * *